US005728327A

United States Patent [19]

Borcoman et al.

[11] Patent Number: 5,728,327

[45] Date of Patent: Mar. 17, 1998

[54] METHOD, BARREL SUBUNITS AND UNITS, SERVICE INSTALLATIONS AND ASSEMBLY STRUCTURES FOR THE FABRICATION OF MOLDABLE PRODUCTS, PARTICULARLY BASED ON CONCRETE

[76] Inventors: Mircéa Borcoman, 4, rue du Gl. H. Bertier; M. Calin Borcoman, 11, rue du Gl. H. Bertier, both of 92200-Neuilly, France

[21] Appl. No.: 275,212

[22] Filed: Jul. 8, 1994

Related U.S. Application Data

[63] Continuation-in-part of PCT/FR93/00004 Jan. 5, 1992.

[30] Foreign Application Priority Data

Jan. 8, 1992 [FR] France ..... 92 00124

[51] Int. Cl.[6] ..... B28B 1/08; B28B 5/10; B28B 7/38

[52] U.S. Cl. ..... 264/39; 264/71; 264/82; 264/228; 264/297.6; 264/297.9; 264/333; 425/62; 425/88; 425/90; 425/174.4; 425/225; 425/404; 425/432; 425/434; 425/443; 425/DIG. 116; 425/DIG. 238; 425/435

[58] Field of Search ..... 264/71, 82, 333, 264/228, DIG. 43, 426, 496, 39, 310, 297.6, 297.9; 425/111, 88, 90, 62, 404, 432, 434, 443, 174.4, 225, DIG. 116, DIG. 238, 435

[56] References Cited

U.S. PATENT DOCUMENTS

| | | |
|---|---|---|
| 3,568,272 | 3/1971 | Zmania . |
| 3,720,493 | 3/1973 | Borcoman et al. . |
| 3,732,044 | 5/1973 | Borcoman . |
| 4,061,454 | 12/1977 | Borcoman . |
| 4,266,916 | 5/1981 | Lubavs . |
| 4,290,740 | 9/1981 | Borcoman . |
| 4,421,710 | 12/1983 | Borcoman . |

FOREIGN PATENT DOCUMENTS

| | | |
|---|---|---|
| A-997536 | 1/1976 | Canada . |
| A-0 012 069 | 6/1980 | European Pat. Off. . |
| A-0 057 635 | 8/1982 | European Pat. Off. . |
| A-964131 | 3/1948 | France . |
| A-2 060 447 | 6/1971 | France . |
| A-2387750 | 8/1978 | France . |
| A-2397973 | 2/1979 | France . |
| A-2950661 | 6/1981 | Germany . |

*Primary Examiner*—Karen Aftergut
*Attorney, Agent, or Firm*—Larson & Taylor

[57] ABSTRACT

The manufacture of moldable concrete products with deferred mold release incorporates molding means bm1 into optimized rotary structures 1, 5, 7, 9, 12 in the form of modular cylinders having at least two faces, the cylinders being equipped and/or associated with means which group together the main work-stations MP, MT, B, D, NH so as to assign a rotary travel of more than 270° and preferably equal to 360° to the curing of the molded material with or without recourse to any means for accelerating the curing.

29 Claims, 15 Drawing Sheets

METHOD, BARREL SUBUNITS AND UNITS, SERVICE INSTALLATIONS AND ASSEMBLY STRUCTURES FOR THE FABRICATION OF MOLDABLE PRODUCTS, PARTICULARLY BASED ON CONCRETE

CROSS-REFERENCE TO RELATED APPLICATIONS

This application is a continuation-in-part application of another international application filed under the Patent Cooperation Treaty on Jan. 5, 1993, bearing Application No. PCT/FR93/00004, and listing the United States as a designated and/or elected country. The entire disclosure of this latter application, including the drawings thereof, is hereby incorporated in this application as if fully set forth herein.

BACKGROUND OF THE INVENTION

Field of the Invention

The present invention relates to a method and to equipment of the rotary drum type, using deferred mould release for the manufacture of moldable products, particularly products based on concrete, aiming to improve the concentration, automation and flexibility of the manufacturing process as well as the curing of the molded material.

Several installations termed "with immediate mould release" exist, which use a rotary circuit just for the curing stage, in which circuit the bare products (already released from the mould) are carried on boards held horizontal.

There are very few rotary installations which use "deferred mould release", mould release carried out after the products have cured in the molding means which themselves travel through the manufacturing circuit with the aid of structures of the rotary drum type.

Known installations of this type have a few drawbacks in design and technological organization which limit their productivity and flexibility performance.

Thus in French Patent Letters 2,060,445 describing structures of the rotary drum type, the main workstations are located as follows, with respect to said structures:

- concreting at the top;
- mould release and evacuation of the cured products at the bottom;
- cleaning-oiling of the molds, placing of the reinforcements and tensioning of the reinforcements, laterally.

This distribution of workstations around the perimeter of the rotary structure gives rise to the following drawbacks:

- limiting the travel assigned to curing to 180°;
- immobilizing additional volumes at the lower and lateral levels of the rotary structures;
- imbalance of the rotary structure, one lateral part being loaded while the other is empty.

In the U.S. Pat. Nos. 4,421,710 and 4,290,740 also describing structures of the rotary drum type, the travel assigned to curing is increased but only up to 270°, whereas the immobilization of additional volumes and the imbalance of the rotary structure are retained. Furthermore, mould release of the cured products laterally is even more difficult than at the bottom.

SUMMARY OF THE INVENTION

The object of the invention is essentially to overcome the aforementioned drawbacks as far as possible.

To these ends, according to a first of its aspects, the invention proposes a method which is essentially characterized:

- in that a plurality of molding means and of covers for closing these is incorporated into optimized rotary structures and thus forms modular rotary cylinders having at least two faces, capable of promoting the concentration, automation and flexibility of the manufacturing process, on the one hand, by assigning a rotary travel of more than 270° and preferably equal to 360° to the curing of the molded material (concrete, mortar, plaster, clay, plastic, etc.) and, on the other hand, by grouping together the main workstations into at least five privileged general technological flow solutions:
  - integral grouping-together above the cylinders;
  - duplicated grouping-together above the cylinders and at one or both ends;
  - duplicated grouping-together above and beside the cylinders;
  - integral grouping-together either at one of the ends of the cylinders or at both;
  - integral grouping-together beside the cylinders.
- in that the concentration, automation and flexibility of the manufacturing process are obtained also by implementation of an evolutive association of rotary cylinders and of installation of utilities which are specific to the method with the aid of optimized assembly structures, said association giving rise to "cylinder-type workshops" for the lowest levels of association and to "cylinder-type factories" for the highest levels of association, which workshops and factories in some cases are produced in the form of units which can be moved by water, rail or road;
- in that the curing of the molded material, such as concrete, is improved by the joint use of the following operational modes:
  - assigning to said curing a rotary travel of more than 270°, and in some cases even more than 360°, when the cooling phase is performed on a secondary cylinder of utilities, associated with the main cylinder;
  - grouping together at the same point the operations of mould release and concreting in order to decrease the thermal shocks on the concrete and draw benefit from the thermal inertia of the molds;
  - modulable transmission of the vibrations produced during the compacting of the concrete to all of the molding means filled with concrete, by adjusting the elastic suspension of said molding means;
  - intensive heat treatment (TTI) of the concrete with this concrete being completely enclosed in the molding means over a travel often equal to a rotation of the cylinders through 360° and with, as a result, enhanced neutralization of the expansion of the gases occluded within the concrete and of the leakage by evaporation of the molecules of water which are indispensable for quality hydration;
  - total multi-axis hydration of the cement molecules due jointly to the change in inclination of the concrete during the 360° of rotation of the cylinders and to the aforementioned residual vibrations.

These five solutions of general technological flow and the extension of the travel assigned to curing make it possible to improve the concentration, automation and flexibility of the manufacturing process as well as the curing of the molded material.

The equipment according to the invention overcomes the aforementioned drawbacks by the implementation of an evolutive association of rotary cylinders and of installations of utilities which are specific to the method, with the aid of a few optimized assembly structures, said association giving rise to "cylinder-type workshops" for the lowest levels of association and to "cylinder-type factories" for the highest levels of association. The cylinder-type workshops and factories may be produced both in the form of small units which can be moved by water, railway or road and in the form of fixed or demountable larger units.

It is recalled that the method and the equipment, according to the invention, relate to the manufacture of all moldable products, but in order to simplify their presentation, the descriptions which will follow refer to the manufacture, with deferred mould release, of products made of concrete, particularly prestressed concrete and reinforced concrete.

For the manufacture of concrete products, two families of cylinder-type workshops and factories are proposed:

- the first family uses "multi-function cylinders" associated with installations of utilities which are ordinary and/or specific to the method, so that the grouping-together of the main workstations (placing of the reinforcements, tensioning of the reinforcements, concreting, deferred mould release, evacuation of the cured products and cleaning/oiling of the molds) can be performed according to the first three abovementioned general technological flow solutions of the method;
- the second family uses "single-function cylinders" associated with ordinary and/or specific installations of utilities so that the aforementioned workstations are grouped together according to the fourth or fifth general technological flow solution of the method.

The multi-function cylinders of the first family of factories firstly include a rotary structure which either is or is not self-supporting with respect to the loadings involved in tensioning the reinforcements (equipped or not equipped with tensioning devices), then secondly molding means (molds or sets of molds) most often equipped with their own compacting means and thirdly means for closing said molding means so that these cylinders mainly afford the following functions:

- taking up the loadings involved in tensioning the reinforcements in the case of the manufacture of products made of prestressed concrete;
- compacting the concrete in the molding means which can be found horizontal at the top of the cylinder;
- moving the molding means which have been filled with concrete and closed, in a rotary curing circuit of 360°, which curing takes place with complete multi-axis hydration and with easy recourse to certain accelerating means (preheating, ordinary heating, intensive heating, vacuum, repeated vibrations, admixtures, etc.);
- automatic replacement of the molding means loaded with cured products in the starting position at the top of the cylinder whence thereafter the other main operations (mould release and evacuation of the cured products, cleaning and oiling of the molds, placing and tensioning of the reinforcements) are carried out with obvious ease.

The single-function cylinders of the second family of factories include, on the one hand, a more lightweight rotary structure (because the uptake of the loadings involved in tensioning the reinforcements is no longer required) and, on the other hand, a series of peripheral niches equipping said structure or integral with it, which niches allow the extraction and reinsertion of the molding means (molds or sets of molds) at the top, at the bottom, or laterally with respect to the cylinders, so that the latter have only a single main function to fulfil, that of causing said molding means, filled with concrete and closed, to travel each time through a rotary curing circuit of 360° with all the aforementioned advantages.

Seven types of multi-function cylinder and three types of single-function cylinder are presented hereafter by way of example.

A first type of multi-function cylinder is produced with the aid of a hybrid rotary structure (steel/concrete), which is self-supporting as regards the loadings involved in tensioning the reinforcements, and with the aid of a few sets of molds, preferably heating ones, equipped with their own vibration means, which sets are fixed with the aid of demountable devices onto each face of the structure, in the form of interchangeable assemblies.

A second type of multi-function cylinder is produced with the aid of a rotary metal structure, self-supporting or not as regards the loadings involved in tensioning, equipped with two top shields, themselves also self-supporting or not, and with the aid of sets of molds, preferably non-heating ones, equipped with their own vibration means, which sets in their rotary curing travel are subjected to intensive heating, preferably by radiation.

A third type of multi-function cylinder is produced with the aid of a rotary structure, self-supporting or not, in the form of a hollow cylinder encompassing the molds, this structure being mounted around a support beam equipped in some cases with two top bogies or trucks so that this cylinder (including the covers for closing the molds) can be moved in one piece by rail either on its own bogies or trucks or on a flat wagon.

A fourth type of multi-function cylinder is produced with the aid of a rotary structure, self-supporting or not, of monolithic type incorporating the molds so that it can be transported in one piece by normal road convoy either on its own axles, or on a low-loader trailer.

A fifth type of multi-function cylinder is produced with the aid of a rotary structure, self-supporting or not, reinforced with the aid of several peripheral beams acting at the same time as mould supports and working platforms, the structure preferably having four faces so that it can be equipped with molding means either on every face, or on just two opposite faces when it is desired for the width of the cylinder not to exceed the normal gauge width for road transport.

A sixth type of multi-function cylinder is produced with the aid of a "lightened rotary structure" (not tasked with taking up the loadings involved in tensioning the reinforcements) and with the aid of a few sets of molds including a fixed support shell and a removable core, itself also multi-functional, it being possible for the core to be self-supporting or not as regards the loadings involved in tensioning the reinforcements.

A seventh type of multi-function cylinder is produced with the aid of a lightened rotary structure and with the aid of sets of molds including tilting lateral walls and a removable multi-function core, preferably one which is self-supporting as regards the loadings involved in tensioning.

A first type of single-function cylinder is produced with the aid of a lightened rotary structure, equipped with several rails-beams and with a rotary steam-distributing device, the structure being equipped with a series of niches which are or are not demountable, so that the molding means equipped with rollers are extracted, loaded with cured products, and reinserted, filled with fresh concrete, into said niches, preferably at the top of the cylinder.

A second type of single-function cylinder is produced with the aid of a lightened rotary structure encompassing a series of niches, preferably ones which are taller than they are wide, these niches being equipped with rollers so that the molding means can be extracted, loaded with cured products, and reinserted, filled with fresh concrete, particularly at the bottom of the cylinder.

A third type of single-function cylinder is produced with the aid of a lightened rotary structure having roller rings located towards the outside between which there are housed several niches, preferably ones which are wider than they are tall, these niches allowing the extraction and reinsertion of the molding means, particularly laterally with respect to the cylinder.

The installations of utilities, ordinary or specific to the method, implement the means associated with the cylinders in order to ensure the manufacturing process proper (from arrival of the fresh concrete right up to exit from the workshop of the cured products) according to one or other of the five general technological flow solutions of the method.

The ordinary installations of utilities include the usual means ensuring the operation of the various workstations (devices for cleaning, oiling, placing the reinforcements, feeding and distributing the concrete, etc.).

The specific installations of utilities are made up of means which have been optimized in order to obtain the best operating conditions for the cylinders with which they are associated, alone or in conjunction with ordinary installations of utilities.

Ten types of specific installation of utilities are presented hereafter by way of example.

The first type is a "grippable installation of covers" mainly including lifting apparatus advantageously made up with the aid of two synchronized electric pulley blocks positioned above the cylinder served, so as to ensure the handling of the covers for closing the molds (removal, holding and putting back on) under conditions which do not allow them to warp, given their lightweight nature.

The second type is a "grippable installation of cured products and reinforcements" which can move above the cylinder served, preferably in its longitudinal axial plane, installation including means which firstly ensure the mould release and transfer of the cured products to the yard and secondly (in the return journey) ensure the transfer of the reinforcements into the molds which can be found cleaned and oiled at the top of the cylinder.

The third type is a "grippable installation of covers, cured products and reinforcements" which can move above the cylinder served, preferably in its longitudinal axial plane, installation including means which ensure:

- removal of the cover closing the molds which have stopped at the top of the cylinder served;
- mould release of the cured products, fitted or not fitted with top screens, and transfer thereof either onto a secondary cylinder, or to a finishing line, or directly to the yard;
- uptake of the reinforcements or of the screens fitted with reinforcements and transfer thereof (in the return journey) into the molds which can be found cleaned and oiled at the top of the cylinder;
- fitting the closure covers onto the molds, after they have been filled.

The fourth type is a "grippable installation of removable cores, cured products and reinforcements", which can move above the cylinder served, preferably in its longitudinal axial plane, the installation being equipped with means which ensure the handling of the removable cores, the cores being fitted firstly with cured products and secondly with reinforcements.

The fifth type is a "grippable installation of the covers, cores, cured products and reinforcements" which can move above the cylinder served preferably transversely with respect to the latter, the installation being equipped with means which ensure:

- removal of the cover closing the set of molds which has stopped at the top of the cylinder and the placing thereof onto the floor, on the opposite side from the workstations;
- removal of the removable core equipped with cured products and transfer thereof through stations of final mould release, cleaning/oiling, placing and tensioning of the reinforcements;
- placing said core equipped with reinforcements back in the set of molds which set can be found cleaned and oiled at the top of the cylinder served;
- the fitting of the closure lid on the aforementioned set once this has been filled with concrete.

The sixth type is a "deferred two-phase mould release installation", of which the first phase termed "initial deferred mould release" takes place, at the top of the cylinder served, by opening the lateral walls of the set of molds in situ, then by removing, with the aid of a grippable installation of the fifth type, the removable core having cured products stuck to these sides and of which the second phase, termed "final deferred mould release" takes place outside the cylinder served, in a workstation equipped with means which detach the cured products from the core, so that said products and the core are then handled independently with the aid of the same aforementioned grippable installation.

The seventh type is an "installation for heat treatment by radiation" including a circular thermal screen mounted in a fixed position right around the cylinder served, the screen being equipped with a series of radiant heaters (electric or gas-fired) over approximately a quarter of its circumference, in the initial part of the latter with respect to the direction of rotation of the cylinder.

The eighth type is a "secondary cylinder" located outside the main cylinder served particularly in its longitudinal axial plane, including a modular rotary framework having the same rate of stepwise rotation as that of the main cylinder served, the framework being equipped and associated with means which on the one hand ensure cooling, overturning and transfer to the yard of the cured products and, on the other hand, ensure the preparation of reinforcements as a group preferably with the aid of top screens and, in some cases, separation screens.

The ninth type termed "ergonomic walkways" includes two removable walkways mounted above the cylinder served, so as to be able to be lowered each time the latter stops in order to allow access for the workforce laterally with respect to the molding means which can be found at the top of the cylinder and so that once said means have been filled, vibrated and closed, the two walkways are retracted in order to allow the cylinder to rotate through one step, during which time said walkways act as guard rails.

The tenth type is a "snow-melting roof structure" including a semicircular thermal screen placed, via a few rollers, on the rings of a single-function cylinder, so that said roof structure, while being very lightweight and of good quality, at the same time as affording protection against inclement weather, ensures automatic closure of the heating rotary niches of said cylinder and instantaneous melting of snow.

The method makes it possible to associate any type of cylinder with several installations of utilities which are ordinary and/or specific in order to obtain a wide range of flexible or specialized cylinder-type workshops, either in the form of small units which can be moved by rail, road or water, or in the form of fixed or demountable larger units.

The "cylinders/utilities installations" associations may be ordinary associations produced in conventional sheds (existing or new) or privileged associations produced with the aid of a few optimized assembly structures.

Four privileged associations are presented by way of example.

The first privileged association incorporates, with the aid of an optimized assembly structure of type 1, a multi-function cylinder of type 1, at least two ordinary installations of utilities (one for feeding/distributing the concrete and one for cleaning/oiling the molds) and three specific installations of utilities (type 1, 2 and 9).

The second privileged association incorporates, with the aid of an optimized assembly structure of type 2, a multi-function cylinder of type 2, at least both the aforementioned ordinary installations and three specific installations (types 3, 7 and 8).

The third privileged association incorporates, with the aid of an optimized assembly structure of type 3, a multi-function cylinder of type 6, all or some of the aforementioned ordinary installations of utilities and a specific installation of type 4.

The fourth privileged association incorporates, with the aid of an optimized assembly structure of type 4, a multi-function cylinder of type 7, all or some of the aforementioned ordinary installations of utilities and two specific installations (types 5 and 6).

The invention consists, apart from the provisions explained hereinabove, of certain other provisions which will be dealt with more fully later with regard to the several preferential and non-limiting exemplary embodiment, described with reference to the appended drawings.

DETAILED DESCRIPTION

Given the extent thereof, the detailed explanation which follows (with references to the drawings quoted hereinabove) is broken down into four main parts, of which the first deals with the method, the second deals with the various types of cylinder, the third deals with the various types of installation of utilities and finally the fourth deals with the various types of "cylinder/utilities installation" association.

The method, in the case quoted as an example of the manufacture of concrete products, performs, by the association of the cylinders and of the installations of utilities, the grouping-together of the main work-stations, placing of the reinforcements (MP), tensioning of the reinforcements (MT), concreting (B), mould release (D) and cleaning/oiling (NH) according to one or other of the five general technological flow solutions with, each time, the whole of the rotary travel through 360° being assigned to the curing of the concrete which, on the one hand, may call upon any known acceleration means (gradual heating, admixtures, processing under vacuum, etc.) and which, on the other hand, benefits from several conditions specific to the method promoting acceleration thereof:

molding means, molds m or sets of molds bm, mounted on each face of the cylinder in the form of modular assemblies preferably equipped with their own vibration and elastic-support means so as, on the one hand, to ensure very effective compacting of the concrete and, on the other hand, to allow it to be revibrated either directly or indirectly by resonance;

intensive heat treatment (TTI) equivalent to the best fast heat treatment made possible by the fact that the concrete is completely enclosed in said molding means for the entire duration of its rotary travel through 360°;

improved hydration (completely multi-axial) of the cement molecules due to the continuous change in inclination of the concrete during the 360° of said rotary travel;

mould release deferred to the top of the cylinder allowing the molding means to be presented for concreting when they are somewhat hot.

The intensive heat treatment, subdivided into three main phases, rise in temperature (TT1), isothermal (TT2) and cooling (TT3), may be performed both in the case of multi-function cylinders and in that of single-function cylinders, in two technological variants, one in which the aforementioned three phases are carried out in full during the rotation of said cylinders through 360°, and the other in which the last phase, that of cooling, is carried out outside the cylinders before or during evacuation (E) of the cured products p.

Figure 1:
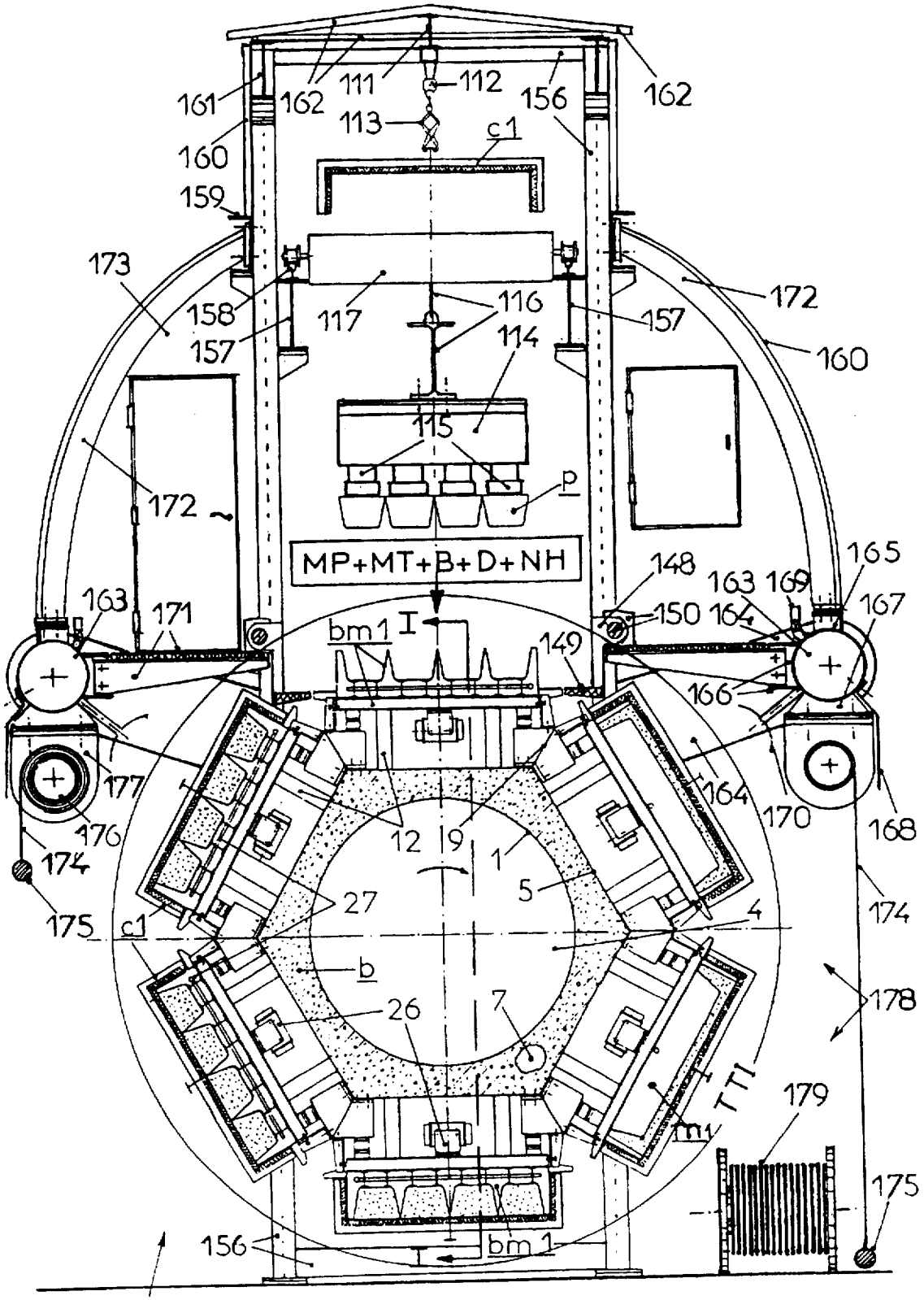
FIG. 1 is the transverse section of a flexible workshop produced according to the first general technological flow solution with the aid of a multi-function cylinder of type 1, associated with two aforementioned ordinary installations of utilities (not represented) and with three specific installations of type 1, 2 and 9.
Figure 2:
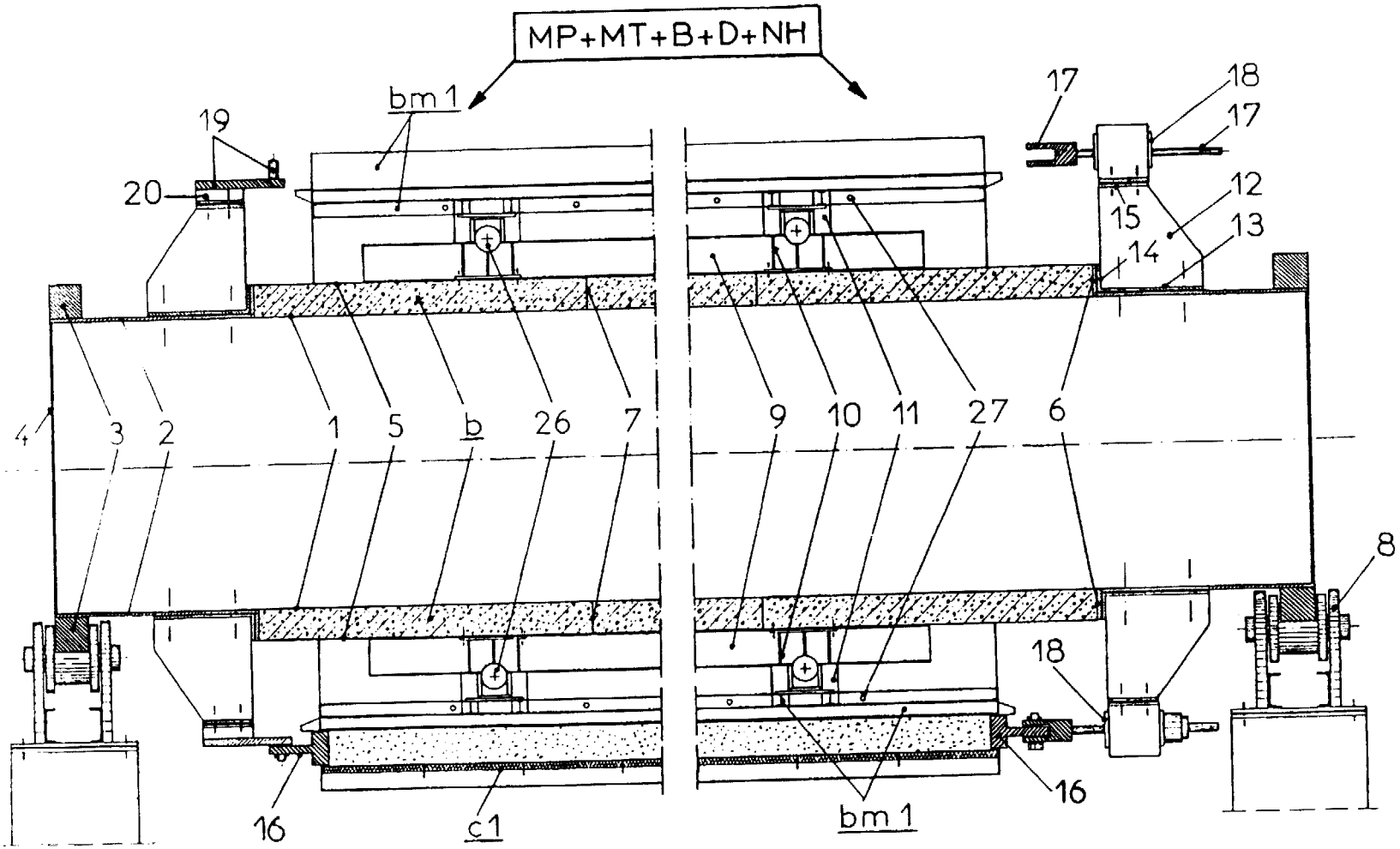
FIG. 2 is the longitudinal section (along the line I—I of FIG. 1) of the cylinder of type 1.
Figure 3:
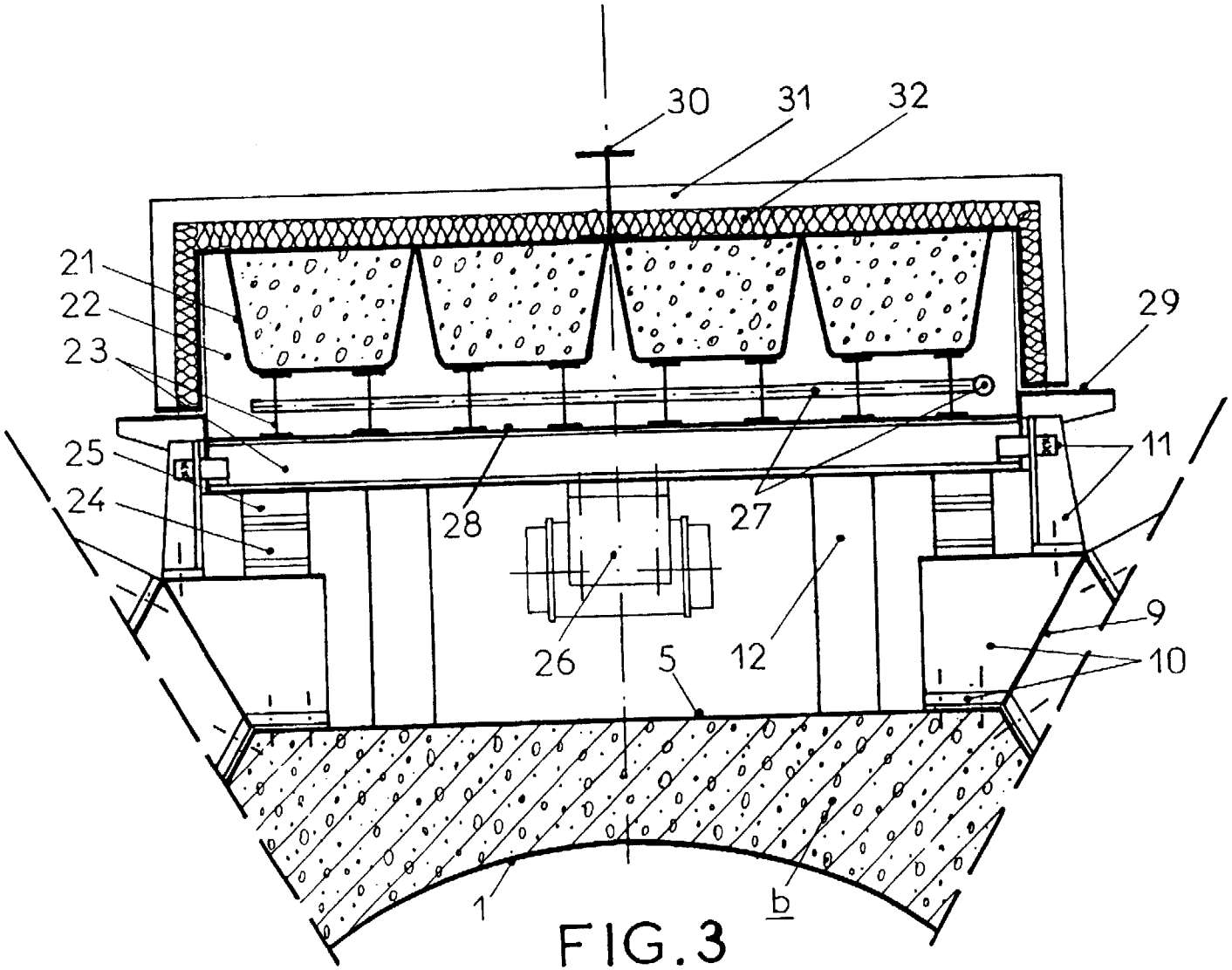
FIG. 3 is the detailed transverse section of a face of the cylinder of type 1.
Figure 6:
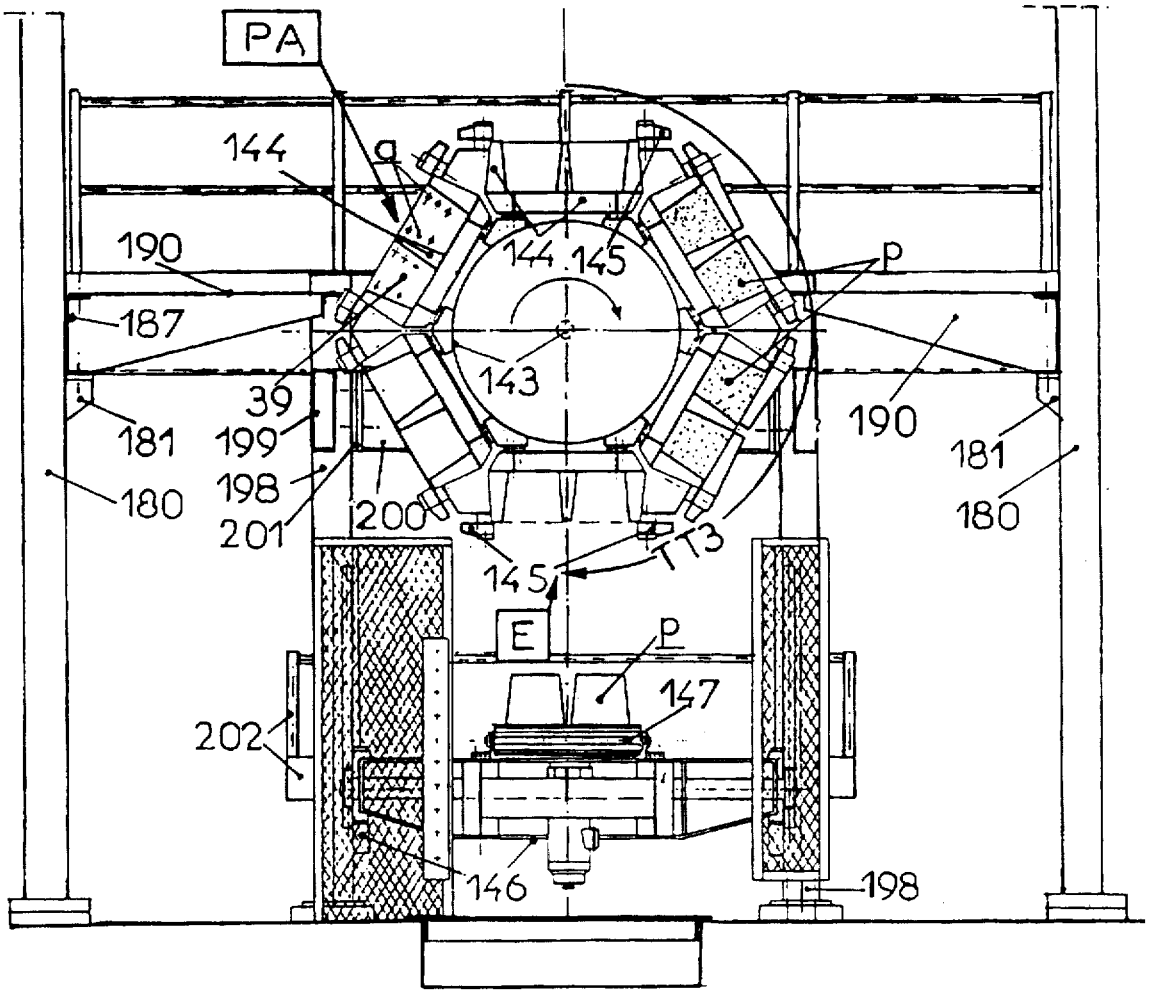
FIG. 6 is the transverse section of a specific installation of type 8 (secondary drum)

The multi-function cylinder of type 1, represented in FIGS. 1, 2 and 3, includes, firstly, a hybrid rotary structure (metal/concrete) which is self-supporting as regards the loadings involved in tensioning the reinforcements a as shown in FIG. 6, the structure being equipped with a few demountable mould support devices and with devices, also demountable, for tensioning the reinforcements, then secondly several heating mould sets bm1 fitted with means of compacting the concrete and with means for distributing the steam, and thirdly heat-insulated closure covers c1 which can be perfectly secured to the aforementioned sets.

The hybrid rotary structure or a rotary body is a light-weight metal framework composed of an outer polygonal membrane 5 and an inner cylindrical membrane 1 placed coaxially in the outer polygonal membrane 5. The outer polygonal membrane 5 is connected to the inner cylindrical membrane 1 by top gusset plates 6 attached at both ends of the inner cylindrical membrane 1 and the outer polygonal membrane 5. Additionally, a plurality of intermediate gusset plates 7 are placed between the top gusset plates 6 and are situated perpendicular to a longitudinal axis of the hybrid rotary structure. A space between the outer polygonal membrane 5 and the inner cylindrical membrane 1 is filled with concrete (b). The hybrid rotary structure becomes thereby extremely rigid and is capable of taking up loads occurring during tensioning of a reinforcement of moldable products. Both ends of the hybrid rotary structure are reinforced by reinforcing rings 2, each having a raceway 3 supported in a stepwise rotation device 8. The hybrid rotary structure is driven around an n-fold rotation axis running horizontally. The hybrid rotary structure is closed at both ends by two tin plate closure elements 4.

Each mould support device is made up of two tangential beams 9, secured to two faces of the rotary structure by seats 10 which simultaneously provide the sets of molds with seating support on the one hand and immobilize them in a controlled way by means of several demountable shoes 11 on the other hand.

Each tensioning device includes, on the one hand, two very rigid anchoring frameworks made up of several gusset plates of thick sheet metal 12, assembled with the aid of a base plate 13, a front plate 14 and an upper plate 15, these frameworks being mounted at both ends of each face of the rotary structure in order to transfer the tensioning loads to the latter and includes, on the other hand, at least two self-supporting and removable top screens 16 which tension the reinforcements as a group with the aid of one or more gripper rods 17 mounted with vertical adjustment by means of a demountable shoe 18 on the anchoring framework on the active head side of the cylinder (this head can be found to the right in FIG. 2) and with the aid of a plate 19 equipped with one or more fingers for fastening onto said screens, this plate also being demountable and mounted by means of a vertical-adjustment component 20 on the anchoring framework on the passive head side of the cylinder (to the left in FIG. 2).

Each set of molds is made up of several shells 21 assembled by gusset plates 22 to a resistive framework 23, the framework being equipped with elastic bearing pads 24, heightwise adjusting wedges 25, vibrators 26, pipes for distributing steam 27, and finally a sealing sheet 28 fitted with two lateral folds 29.

Each removable cover is made up of a longitudinal beam 30, of a series of transverse gusset plates 31, then of a heat-insulated jacket 32, the end stiffening edges of which stop the heat insulation and, by means of good contact surface, ensure leaktight junction with the lateral folds 29 of the aforementioned sealing sheet 28.

Figure 4:
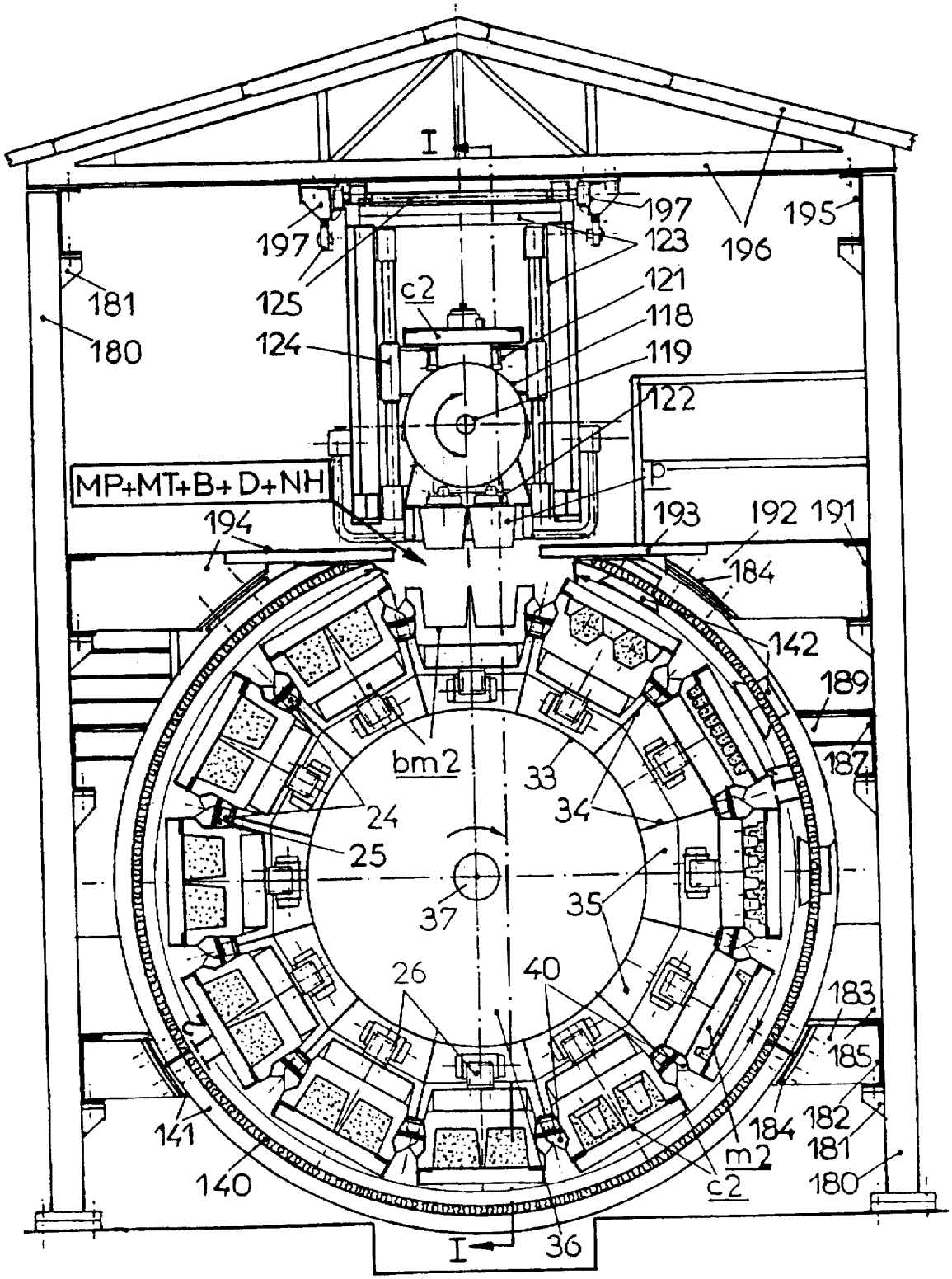
FIG. 4 is the transverse section of a flexible workshop produced according to the second general technological flow solution with the aid of a multi-function cylinder of type 2, associated with two aforementioned ordinary installations of utilities (not represented) and with three specific installations of types 3, 7 and 8.
Figure 5:
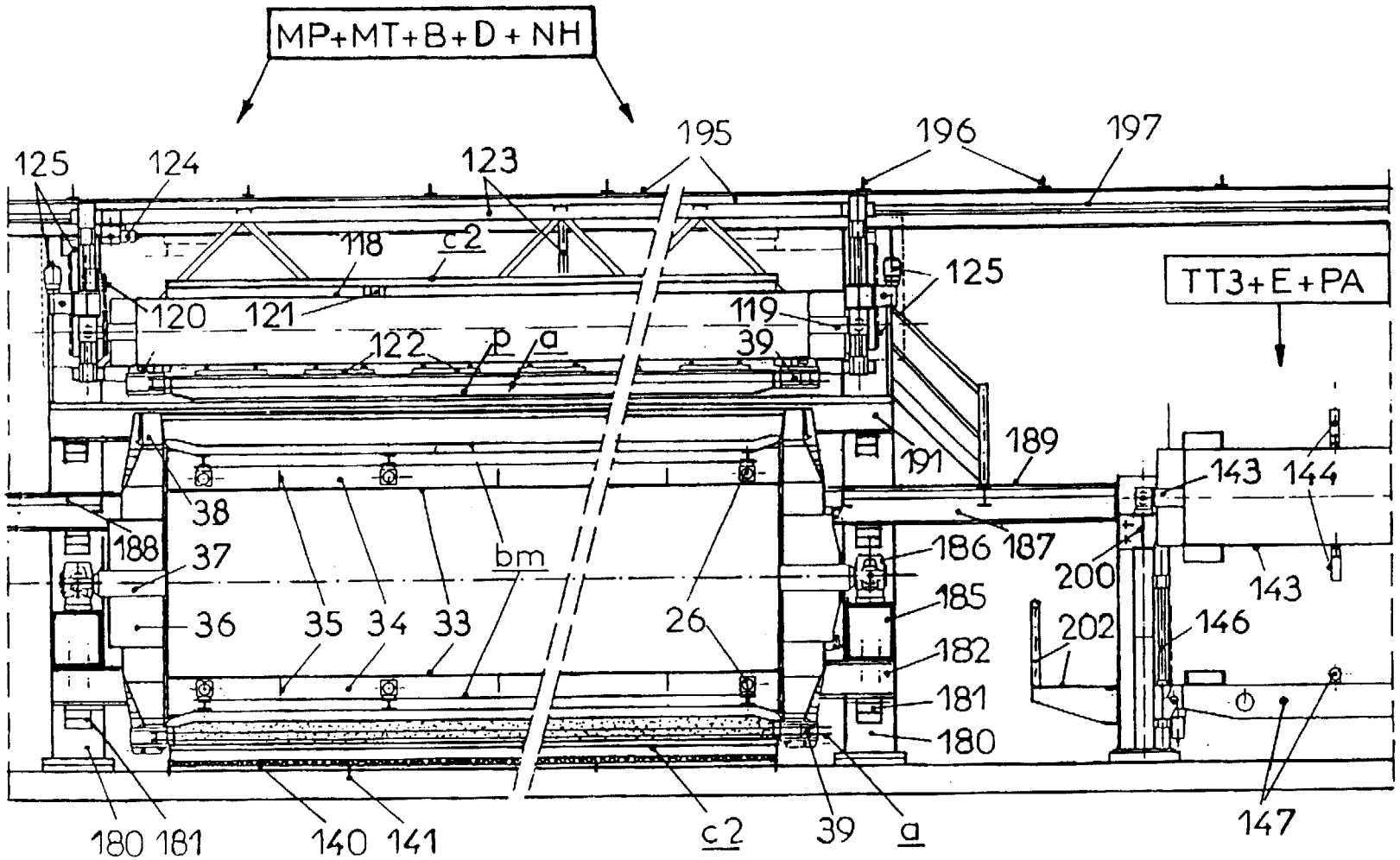
FIG. 5 is the longitudinal section (along the line I—I of FIG. 4) of the aforementioned flexible workshop showing the multi-function cylinder of type 2, the specific installation of type 3, and just part of the specific installation of type 8.

The multi-function cylinder of type 2, represented in FIGS. 4 and 5, includes, on the one hand, a rotary structure which is self-supporting or not (equipped or not equipped with devices for tensioning the reinforcements) made up of a metal membrane 33, particularly a cylindrical one, reinforced by a few radial beams 34 with a high moment of inertia and by a series of bracing gusset plates 35, the structure having two top shields 36, also self-supporting or not, the shields being equipped with rotation spindles 37 and with a few sloping seats 38, facilitating the exit by sliding of the top screens 39 during mould release, and it includes, on the other hand, sets of non-heating molds bm2, equipped with elastic bearing pads 24, adjustment wedges 25, vibrators 26 and a few lateral fixing seats 40, these sets being closed with the aid of non-heat-insulated removable covers c2 so that the heating of the concrete can be carried out from the outside with the aid, for example, of a specific installation of utilities of type 7.

Figure 7:
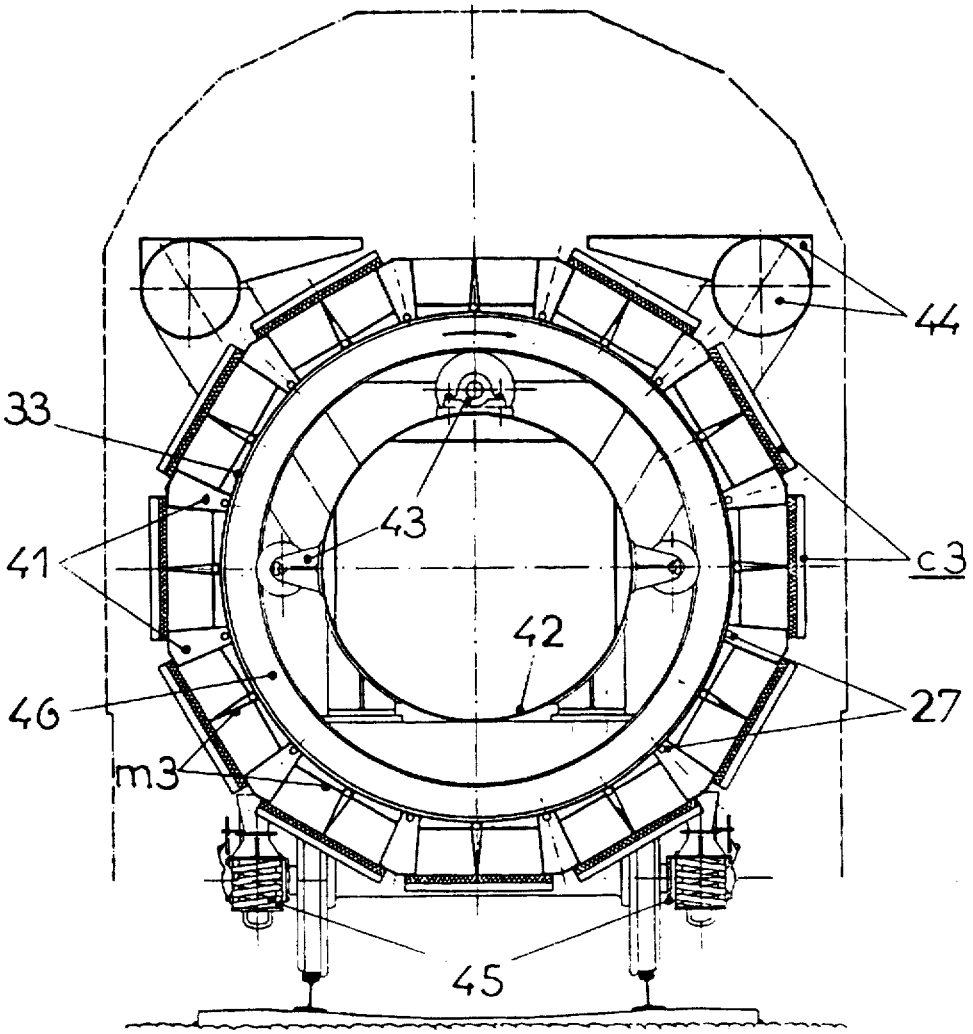
FIG. 7 is the transverse section of a multi-function cylinder of type 3 equipped with its own bogies or trucks for international rail transport.

The multi-function cylinder of type 3, represented in FIG. 7, includes, on the one hand, a rotary structure which is self-supporting or not (equipped or not with devices for tensioning the reinforcements) made up of a membrane, particularly a cylindrical one 33, reinforced with the aid of box beams 41, which structure encompasses the molds m3 and the steam pipes 27, and it includes, on the other hand, a support beam 42, particularly a tubular one, equipped with a stepwise rotation device 43, with two working platforms 44 and with two railway trucks 45 or road axles, so that by mounting said structure equipped with closure covers c3 around the support beam 42 with the aid of raceways 46, a mobile and compact cylinder is obtained in the right condition to respect the international gauge width for rail or road transport.

Figure 8:
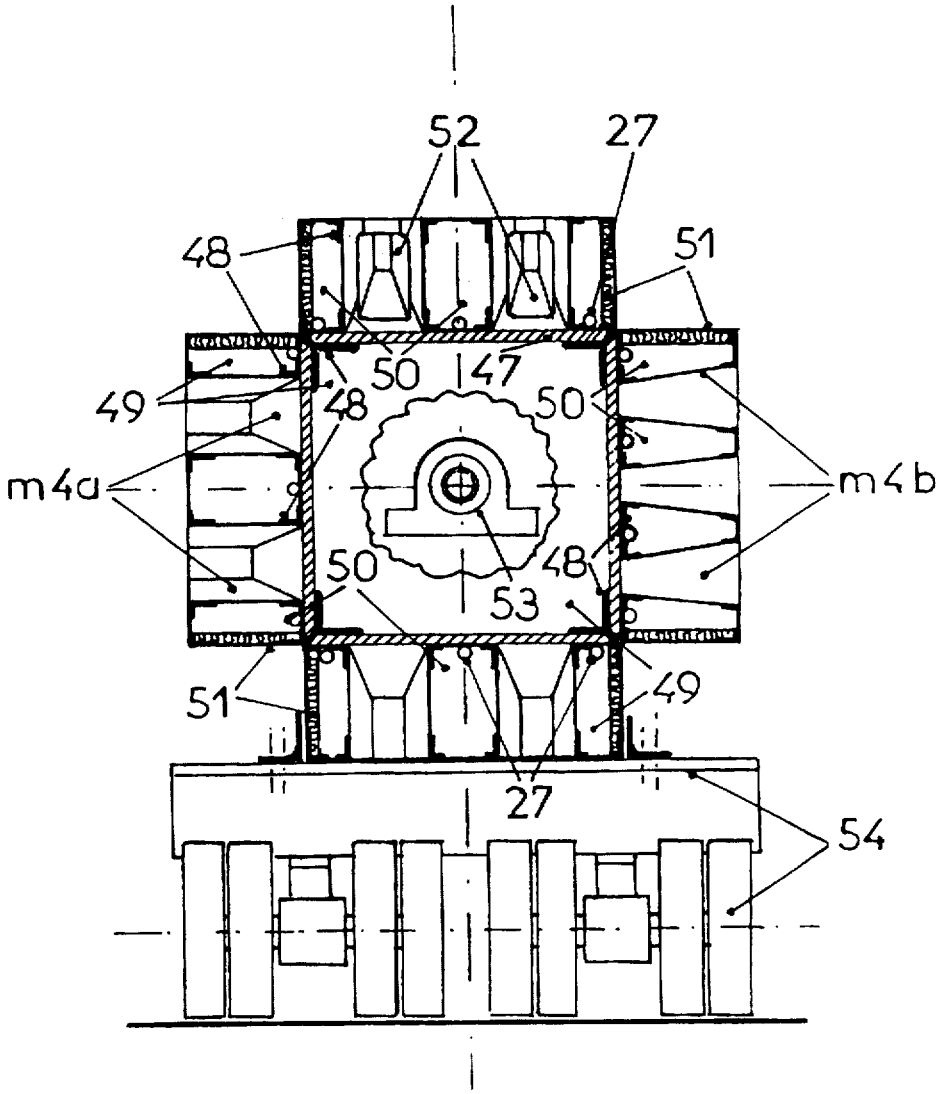
FIG. 8 is the transverse section of a multi-function cylinder of type 4 shown on a road-transport means of the international gauge width.

The multi-function cylinder of type 4, represented in FIG. 8, designed for manufacturing in particular products (solid or hollow) with a longitudinal and/or transverse batter includes, on the one hand, a cross-shaped rotary structure, self-supporting or not, the central part of which is a hollow beam 47, preferably square, longitudinally reinforced by a few sections 48 and transversely reinforced by gusset plates 49, and each of the four arms of which incorporates either molds with longitudinal batter m4*a*, or molds with transverse batter m4*b*, said molds being incorporated as strengthening elements which can, with their reinforced 48, 49 heating 50 walls, take up and distribute the loadings involved in tensioning and as utilities means because their heat-insulated lateral walls 51 automatically become walkways for access each time the cylinder stops, and on the other hand it includes means (not represented) for closing the molds, molding cores with reservations 52 advantageously in the shape of a pyramid frustum, and prebalanced bearing blocks 53 designed to receive, on site, bedplate beams allowing the cylinder to be rested on pre-established foundations after the road 54 or rail transport means of international gauge width have been removed.

Figure 9:
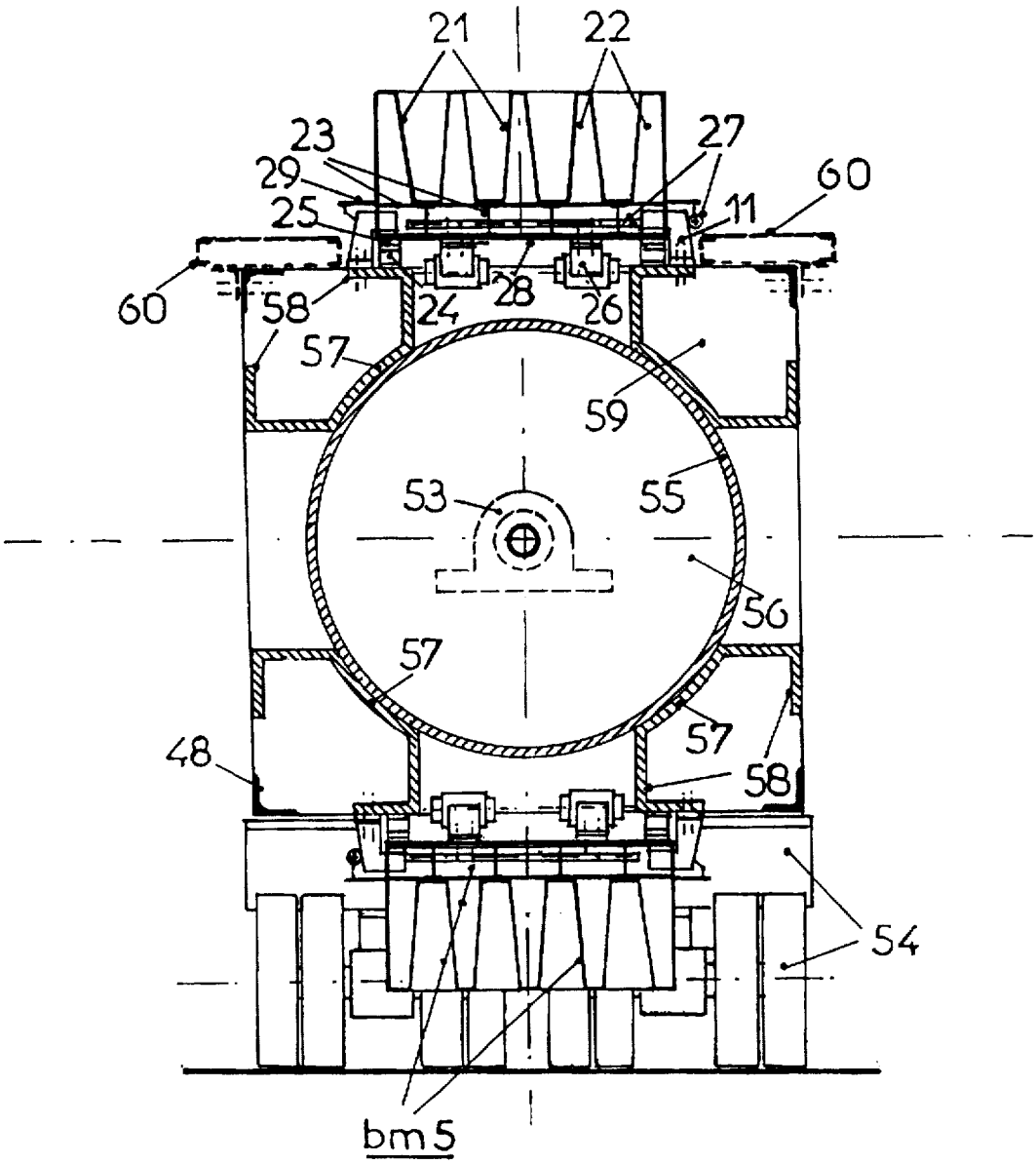
FIG. 9 is the transverse section of a multi-function cylinder of type 5 shown on a road-transport means of the international gauge width.

The multi-function cylinder of type 5, represented in FIG. 9, firstly includes a rotary structure with at least two faces, self-supporting or not, made up of a central beam 55, particularly a tubular one, reinforced by stiffening thin plate elements 56 and of at least four multi-function peripheral beams, secondly includes sets of heating molds bm5 and thirdly includes prebalanced bearing blocks 53 like the aforementioned ones, with two bedplate beams which have not been represented so that this cylinder can be transported in accordance with regulations on a road or rail chassis 54 without molds or with two sets of molds (on the opposite vertical faces) and so that it can be started up on site rapidly either with two sets or with additional sets mounted in situ.

Each multi-function beam is an optimized framework having a central part 57 which is curved according to the outside radius of the tubular beam to which it is welded, also having two mould bedplate arms 58 provided with immobilizing shoes 11 and finally having a series of gusset plates 59 on which a few removable plates of checkered plate 60 are mounted, forming lateral walkways incorporated into the cylinder, so that said multi-function beams simultaneously ensure:

- the reinforcement of the rotary structure particularly when the latter must take up the loadings involved in tensioning the reinforcements;
- the support bedplate of the sets of molds;
- the controlled immobilization of said sets as they rotate;
- lateral access to the molding means on the incorporated walkways.

Figure 10:
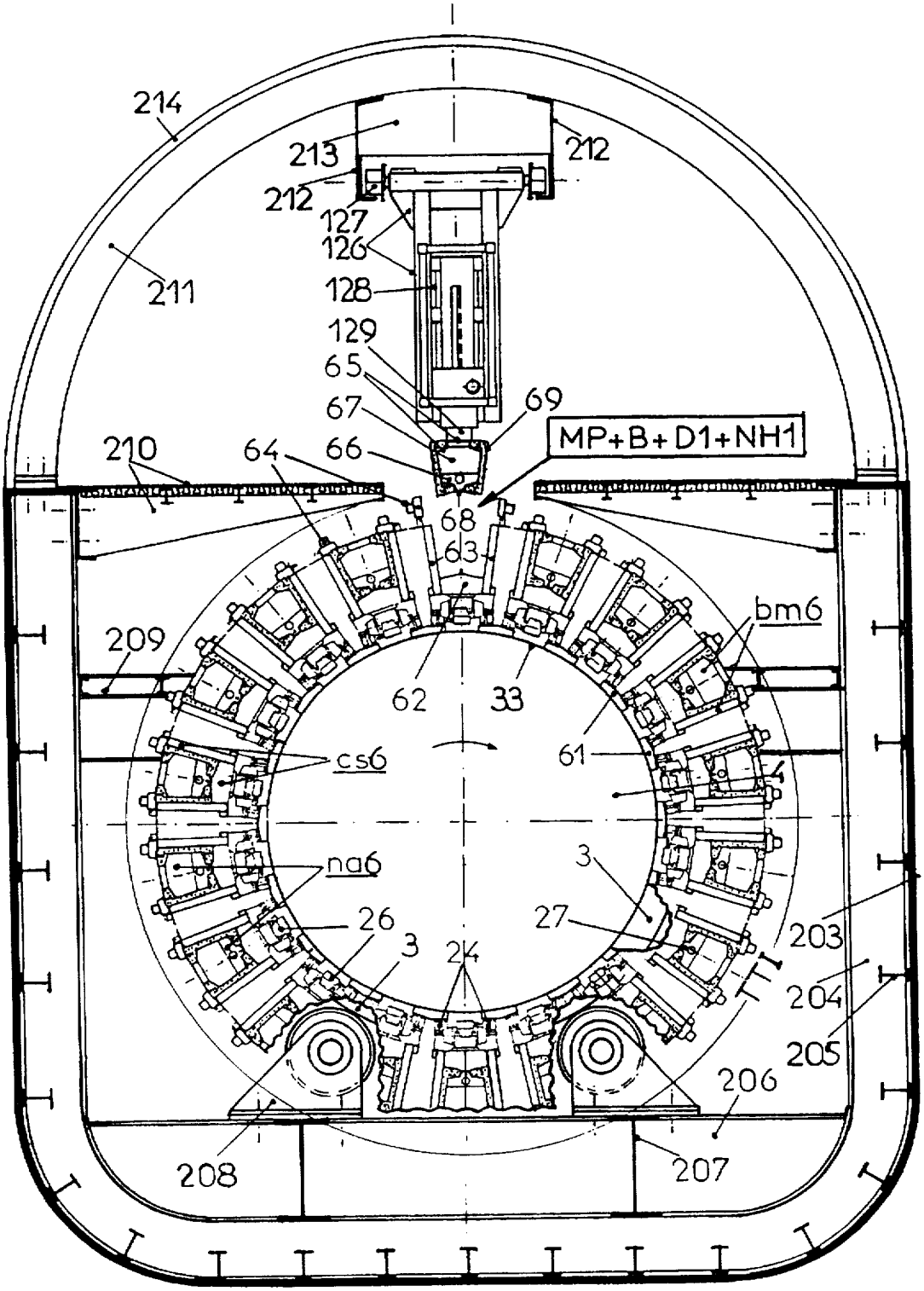
FIG. 10 is the transverse section of a specialized workshop accommodated in a boat hull, the workshop being produced according to the second general technological flow solution with the aid of a multi-function cylinder of type 6, associated with all or some of the aforementioned ordinary installations of utilities and with a specific installation of type 4.

The multi-function cylinder of type 6, represented in FIG. 10, firstly includes a lightened rotary structure (not tasked with taking up the loadings involved in tensioning the reinforcements) made up of a membrane 33, particularly a cylindrical one, equipped with a few box beams 61 for reinforcement and for fixing molds, two top thin plate closure elements 4 and two raceways 3 and secondly a few sets of molds bm6 allowing some products to be poured on edge, the sets being made up with the aid, on the one hand, of a support shell cs6, of the open type, having a support framework 62 and two fixed lateral walls 63 slightly inclined outwards, this shell being equipped with elastic bearing pads 24, with one or more vibrators 26 and with a few devices 64 for closing the upper side and with the aid, on the other hand, of a multi-function removable core na6.

This core made up of a shell of the closed type 65 equipped, on the one hand, with two top thin plate closure elements 66 and with a few transverse reinforcing gusset plates 67 and, on the other hand, with fixing pieces 68 and with a pipe for distributing the steam 27, may either be self-supporting with regard to the loadings involved in tensioning in the case of manufacture of products made of prestressed concrete, or non-bearing with respect to said loadings in the case of manufacture of products made of reinforced concrete. In the latter case, represented by way of example in FIG. 10 for the manufacture of ribbed slabs of reinforced concrete 69, said core, fixed into its support shell, firstly ensures the edge-on pouring of two slabs face to face and of several top to top and secondly ensures the heat treatment TT of the concrete over the entire rotary travel of said sets through 360° so that when it again reaches the top of the cylinder it is thirdly taken up by a specific installation of utilities of type 4 which in the outward journey carries out initial mould release D1 and evacuation E of said cured slabs and, in the return journey, places MP reinforcements (which are fastened onto said core in the place of the evacuated slabs).

Figure 11:
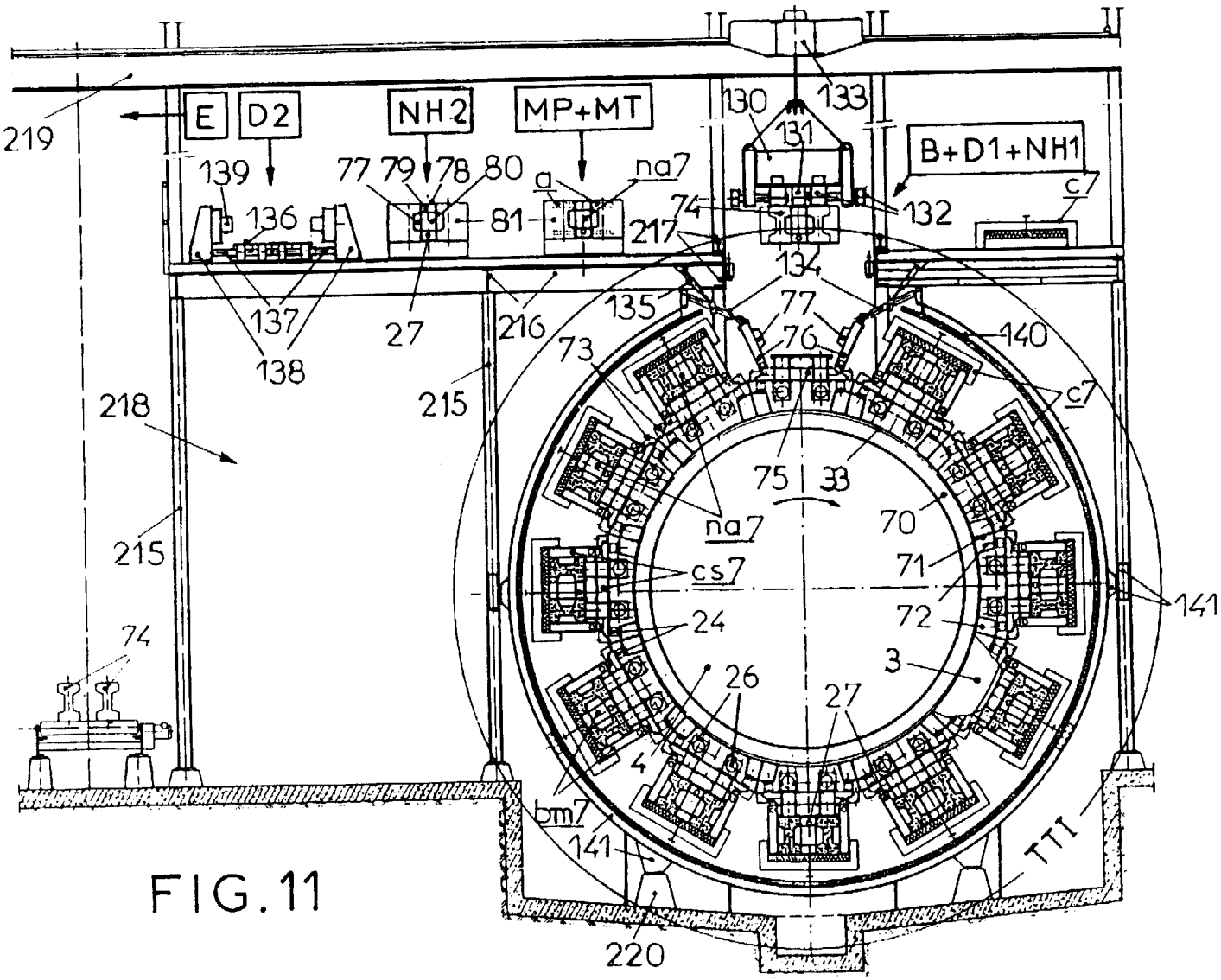
FIG. 11 is the transverse section of a specialized workshop produced according to the third general technological flow solution with the aid of a multi-function cylinder of type 7, associated with all or some of the aforementioned ordinary installations of utilities and with two specific installations of types 5 and 6.

The multi-function cylinder of type 7, represented in FIG. 11, firstly includes a lightened rotary structure made up with the aid of a membrane 33, particularly a cylindrical membrane, equipped with two raceways 3 and reinforced by several rings 70, by two top thin plate elements 4 and by a series of longitudinal beams 71, the beams being equipped with a few mould support seats 72 and with a few pieces 73 for immobilizing the molds with elastic contact and secondly includes sets of molds bm7 allowing the pouring side by side of products made of prestressed or reinforced concrete, such as, for example, posts 74 for electric lines, the sets being produced individually with the aid, on the one hand, of a support shell of open type cs7 having a common bottom 75 and two tilting and heating lateral walls 76, the shell being equipped with a few reservation pieces 77, elastic supports 24 and vibrators 26, and with the aid, on the other hand, of a removable multi-function core na7, self-supporting or not as regards the loadings involved in tensioning the reinforcements.

Advantageously, the core of self-supporting type is made up in the form of a very rigid removable assembly, with the aid of a welded shell made of thick sheet metal 78 reinforced by two top thin plate closure elements 79 and by a series of antibuckling gusset plates 80, this shell being equipped, on the one hand, with reservation pieces 77 and with a steam distribution pipe 27 and, on the other hand, with two self-supporting top screens 81 so that by fixing this core into the support shell cs7 which can be found cleaned and oiled at the top of the cylinder and by closing the lateral walls 76 it firstly pours two posts side by side and secondly carries out intensive heat treatment TT of the concrete completely enclosed with the aid of heat-insulated covers c7 during its entire rotary travel through 360°, and so that at the end of said travel, when the core returns to the top of the cylinder having a post stuck on each side, it is taken up by a specific installation of type 5 and moved through the main workstations located outside the cylinder either longitudinally or preferably transversely (FIG. 11) with respect to the latter.

Figure 12:
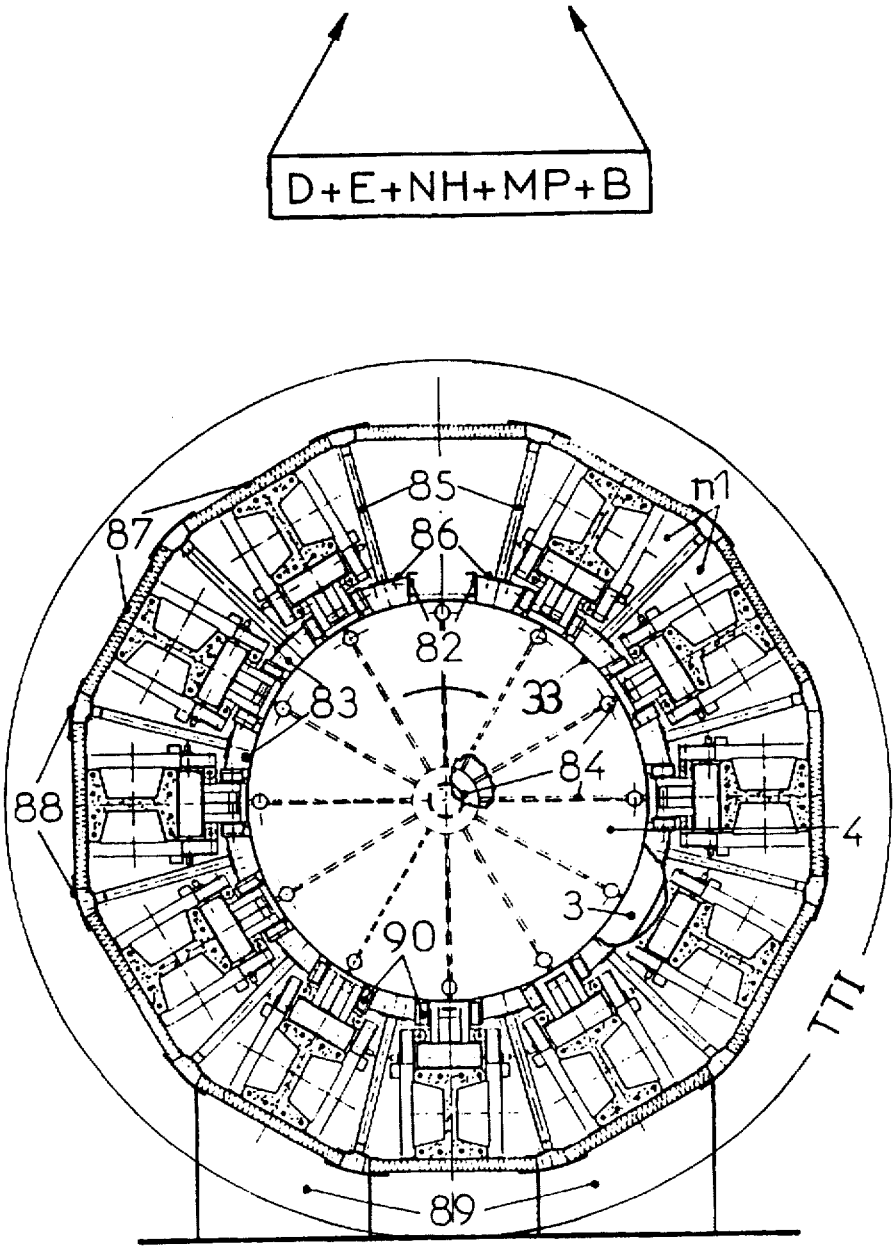
FIG. 12 is the transverse section of a single-function cylinder of type 1, equipped with heating niches allowing the extraction and reinsertion of the molding means at the top of said cylinder.

The single-function cylinder of type 1, represented in FIG. 12, includes, on the one hand, a lightened rotary structure made up with the aid of a membrane 33 equipped with two raceways 3, two top thin plate elements 4 and several rail beams 82 assembled in pairs with the aid of support gusset plates 83, the structure being equipped with a rotary device 84 for distributing steam, and includes, on the other hand, a series of peripheral heating niches n1, preferably demountable ones, made up with the aid of radial walls 85 equipped with their own fixing means 86 and with the aid of heat-insulated peripheral covers 87 also equipped with their own fixing means, the niches being closed at one end by a heat-insulated screen and at the other end by a door also heat-insulated so that by closing off the spaces between the peripheral covers with the aid of a few sealing strips 88 an independent installation for intensive heat treatment TTI is obtained which can be mounted in the open air on four small foundations 89, the installation having the station for extraction and reinsertion of the molds equipped with rollers 90 preferably at the top of the cylinder.

Figure 13:
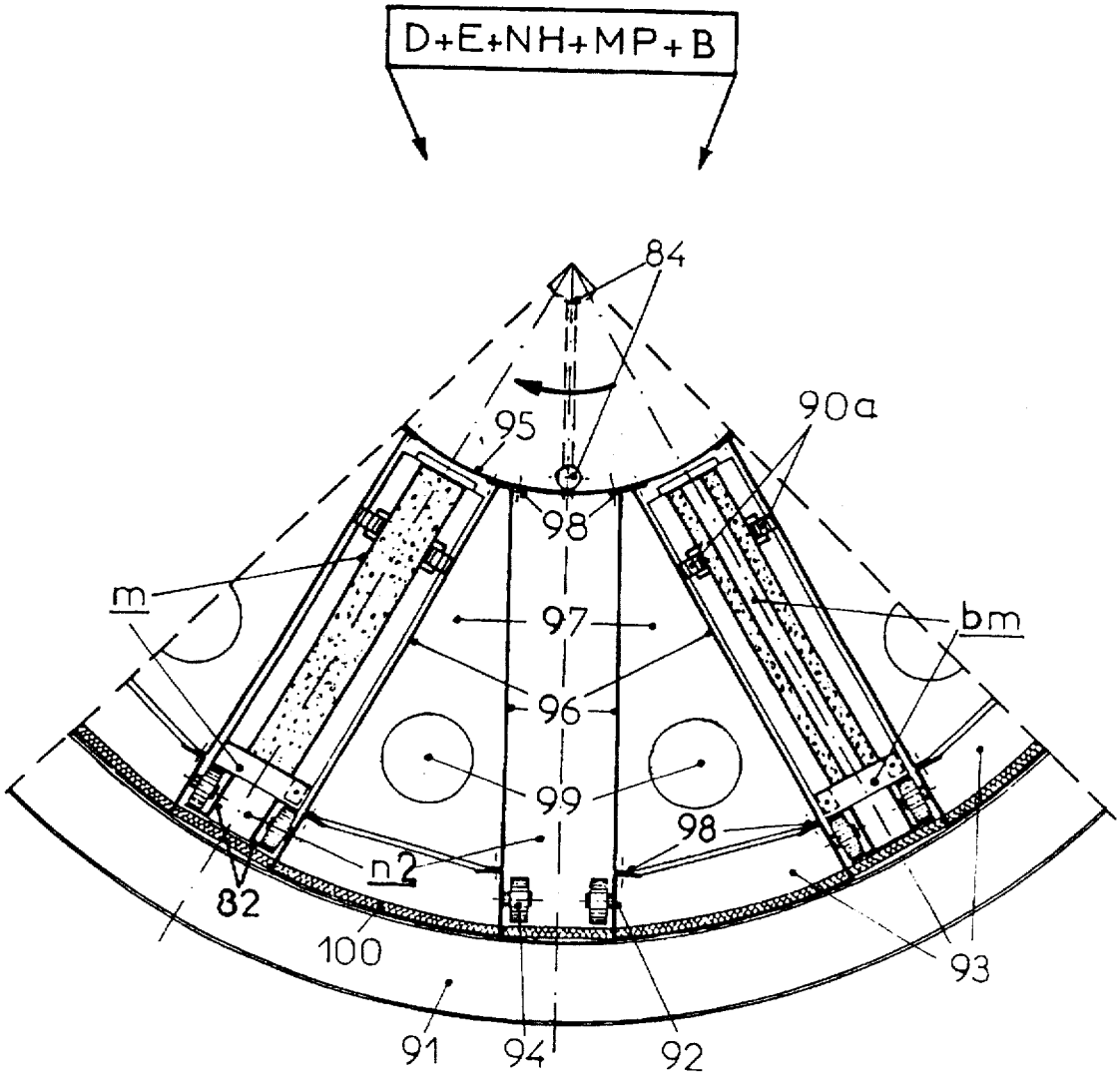
FIG. 13 is the transverse section of a single-function cylinder of type 2, equipped with heating niches allowing the extraction and the reinsertion of the molding means at the bottom of said cylinder.

The single-function cylinder of type 2, represented in FIG. 13, includes a rotary structure incorporating heating niches n2, the structure being made up with the aid, on the one hand, of two peripheral rings 91 connected by a series of longitudinal beams 92 reinforced by gusset plates 93 and equipped with rollers 94 and with the aid, on the other hand, of a tubular beam 95 located in the axis of the cylinder and equipped with a rotary device 84 for the distribution of steam, so that by radially connecting the longitudinal beams 92 in pairs to the tubular beam 95 with the aid of a few demountable walls 96, particularly "V"-shaped ones, these walls being reinforced by gusset plates 97 and equipped with a few connection pieces 98, and so that by closing said structure using top heat-insulated walls 99 and peripheral heat-insulated walls 100, a series of heating niches is obtained, these niches usually being taller than they are wide n2, incorporated into the rotary structure ready to form with the latter an independent intensive heat treatment installation preferably having the station for extraction and reinsertion of the molding means (mould or sets of molds) at the bottom of the cylinder.

Figure 14:
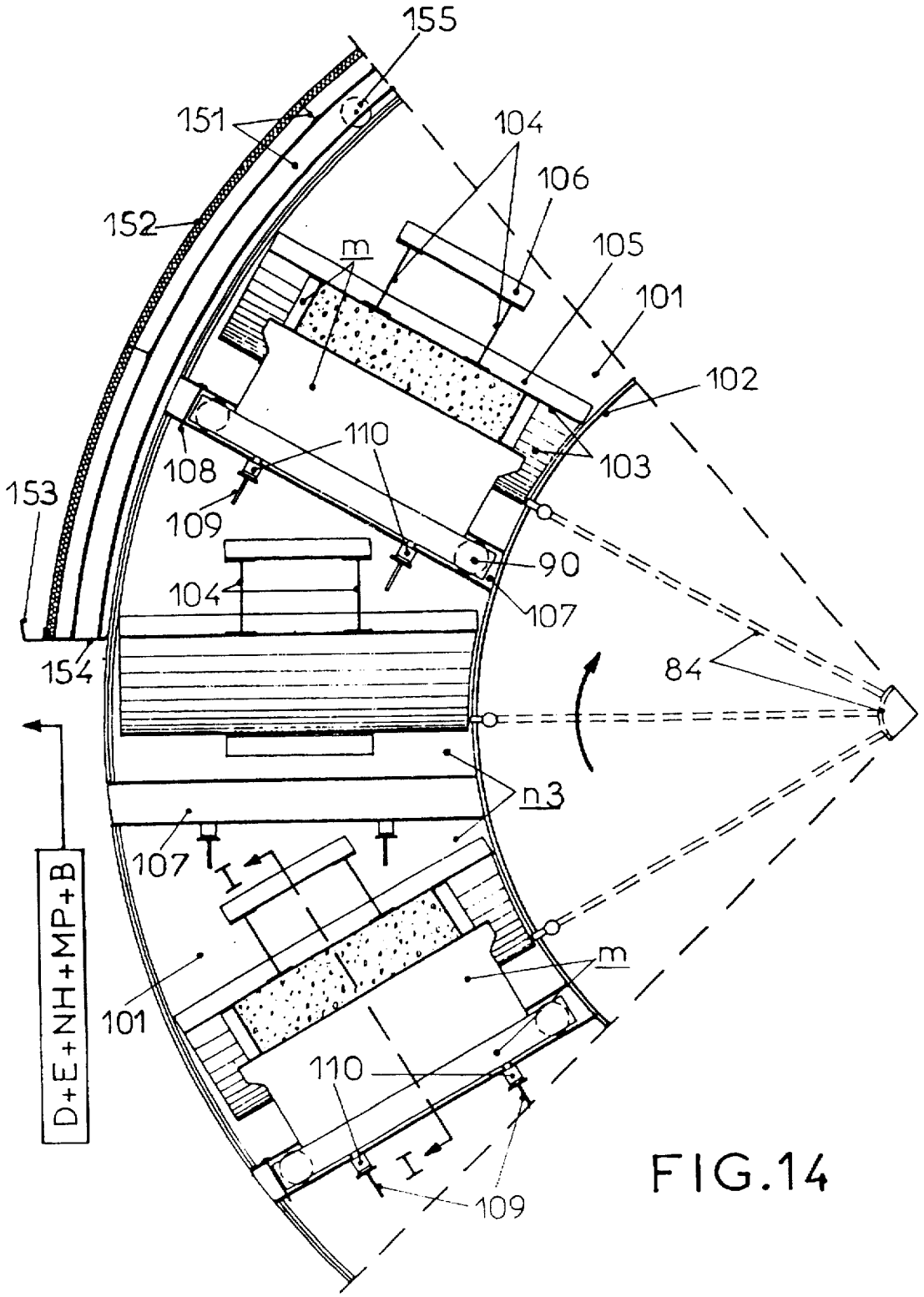
FIG. 14 is the transverse section of a single-function cylinder of type 3, equipped with heating niches allowing the extraction and reinsertion of the molding means laterally, the cylinder being associated with a specific installation of utilities of type 10.
Figure 15:
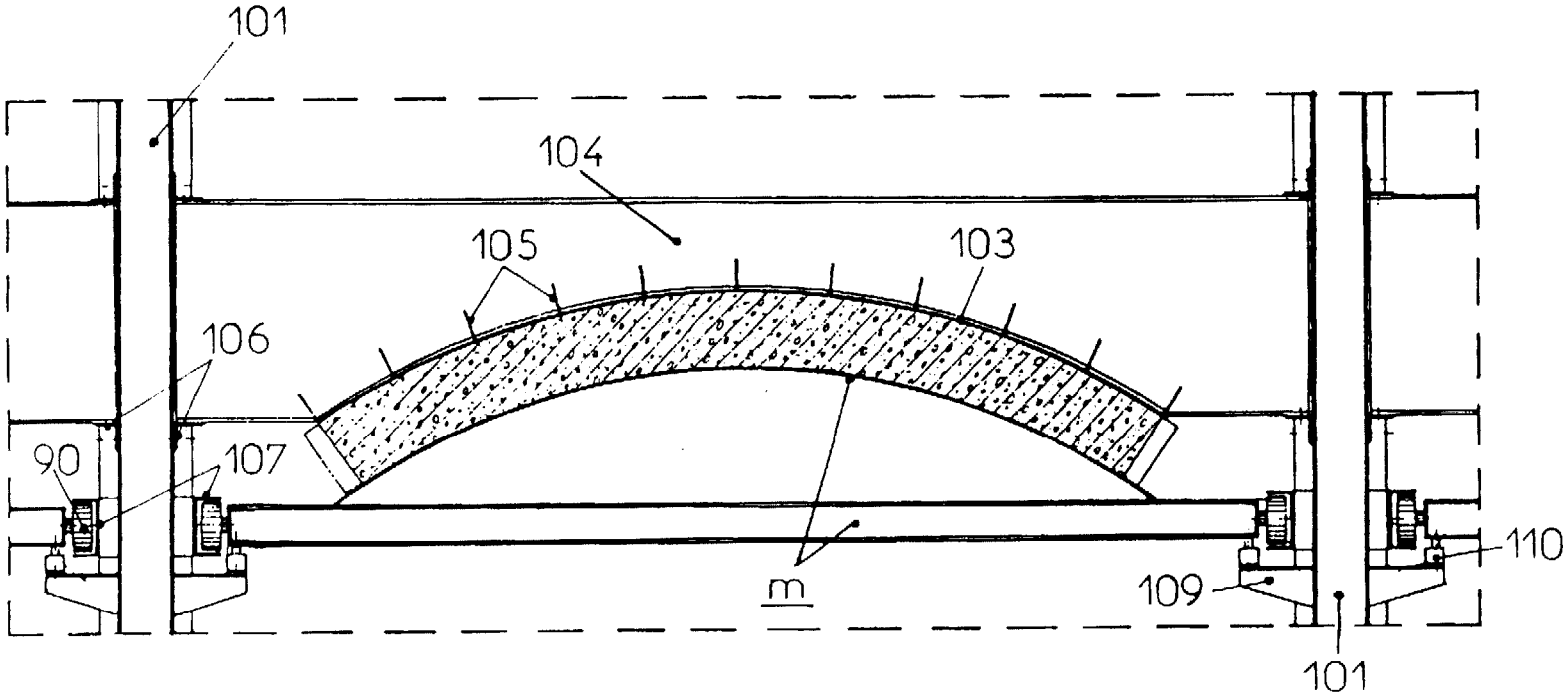
FIG. 15 is the partial longitudinal section (along the line I—I of FIG. 14) of the single-function cylinder of type 3.

The single-function cylinder of type 3, represented in FIGS. 14 and 15, includes, on the one hand, a rotary structure which is fitted with the aid of two or more box rings 101 mounted on the outside of a cylinder 102 so as to be able to place heating and demountable niches n3, preferably wider than they are tall, between said rings, it being possible for the niches to receive and carry, in their stepwise rotation through 360°, molds (or sets of molds) equipped with rollers 90, allowing horizontal pouring of products having a special structure and/or shape such as, for example: decorative panels, sandwich panels, segments for the construction of tunnels, etc. For the latter case relating to the manufacture of segments, the niches are, on the one hand, made up of covers 103 matching the curvature of said segments, said covers being welded onto a framework including beams 104, gusset plates 105, and angle brackets 106 for mounting said framework between two rings, and are, on the other hand, equipped with rails 107 allowing the extraction and reinsertion of the molds, with devices 108 for immobilizing the molds in said rails and with a few lifting devices 109, preferably having hydraulic jacks 110, which lift the molds after their insertion so that the free face of the concrete matches the covers 103 during the intensive heat treatment TTI over the entire travel through 360°.

The ten types of cylinder described are advantageously served by one or more of the ten types of specific installations of utilities explained hereafter.

The specific installation of type 1, represented in FIG. 1, includes apparatus for handling the covers c1, this apparatus being made up of a horizontal beam 111 overhanging the upper face of the cylinder served in its longitudinal axial plane and of two electric pulley blocks 112 equipped with gripping means 113, preferably with grippers, the electric pulley blocks being suspended from said beam with a distance of 0.54 l between them ("l" being the length of the covers) so that the bending moment of the covers given their length is considerably reduced resulting in a great decrease in their weight and in the power of the electric pulley blocks.

The specific installation of type 2, represented in FIG. 1, includes at least two demountable gripping devices 114, equipped with gripping means, preferably with suckers 115, for the cured products, and with gripping means, preferably with grippers for the reinforcements, these devices being suspended via a beam 116 with a high moment of inertia from vertical-lifting and horizontal-translation apparatus 117 overhanging the upper face of the cylinder served so that this installation carries out or facilitates:

mould release D of products P;

transfer of said products either onto an ordinary installation of utilities or onto a specific installation of utilities of type 8 mounted outside the cylinder served preferably in its longitudinal axis;

transfer and placing MP of the reinforcements;

mounting and changing of the molding means.

The hybrid rotary structure shown in FIGS. 1 and 2 has a position, where a first attachment means made of two tangential beams 9 and by seats 10 is situated in an upper defined position. The first attachment means faces upwardly in the upper defined position. Then, one of moldings means bm1 is mounted to the first attachment means. After filling the molding means with material to be molded, the molding means is covered with a cover c1. The hybrid rotary structure is rotated to a position, where a sequentially following attachment means is placed in the upper defined position. In this position, the sequentially following molding means is attached, filled and covered. The steps of rotating the hybrid rotary structure, attaching, filling and covering the sequentially following molding means are repeated until all molding means are covered. The material is then cured in each of the molding means. The cover c1 is taken up by the gripping means 113 when the molding means bm1 is placed in the upper defined position. Products p are taken from the molding means bm1 by the gripping devices 114 equipped with the suckers 115. The molding means bm1 are then cleaned and oiled.

The specific installation of type 3, represented in FIGS. 4 and 5, includes a tilting beam 118 equipped with two top spindles 119, with a device 120 for tilting through 180°, with gripping means for the covers 121, and with demountable gripping means 122 for the cured products and reinforcements, the beam being mounted on a suspended carriage 123 overhanging the upper face of the cylinder served, the carriage being equipped with a vertical-displacement device 124 and with a horizontal-displacement device 125, so that this installation ensures or facilitates:

removal and tilting through 180° of the cover c2 closing the molding means which have stopped at the top of the cylinder served;

mould release D of the cured products P, which are fitted, in some cases, with top screens 39;

transfer of said products either onto an ordinary installation of utilities or onto a specific installation of utilities of type 8, mounted outside of the cylinder served, preferably on its longitudinal axis;

transfer and placing MP of the reinforcements in the molding means m or bm which can be found cleaned at the top of the cylinder;

fitting the closure cover onto the molding means once they have been filled with concrete;

mounting and changing of said molding means.

The specific installation of type 4, represented in FIG. 10, includes a multi-purpose carriage 126 overhanging the upper face of the cylinder served, the carriage incorporating horizontal-displacement means 127, vertical-displacement means 128, as well as gripping means for the cores 12g, so that this installation ensures or facilitates:

initial mould release D1 by removal, at the top of the cylinder served, of the multi-function core na6, entraining at least one cured product 69 on each lateral wall;

transfer, in its outward journey, of said core loaded with cured products to the final mould release station D2, preferably situated in the longitudinal axial plane of the cylinder served, towards the exit to the yard;

transfer, in its return journey, of the core loaded with reinforcements instead of the cured products into the support shell cs6 which can be found cleaned and oiled at the top of the cylinder served.

The specific installation of type 5, represented in FIG. 11, includes a tool holder framework 130, equipped with a central row 131 of fixed gripping means for the cores and with two lateral rows 132 of gripping means which can be moved apart for the cured products, the framework being suspended from a travelling crane 133 which can move above the cylinder served, preferably transversely with respect to the latter, so that this installation ensures, in succession:

removal of the cover c7, closing the set of molds which has stopped at the top of the cylinder and transfer thereof onto the right-hand side of the floor overhanging the cylinder (on the opposite side from the workstations);

initial mould release D1, by removal, secondly, of the multi-purpose core na7 entraining a cured product, such as, for example, a voided post 74, on each lateral wall;

transfer of said core loaded with two posts to the final mould release station D2 situated at the left-hand end of the aforementioned floor;

evacuation of the cured products;

transfer of the core released from its mould through the stations of cleaning/oiling NH and placing and tensioning of the reinforcements MP+MT;

finally, transfer of the core loaded with reinforcements a into its support shell cs7 which can be found cleaned and oiled NH at the top of the cylinder;

mounting and changing of the molding means.

The specific installation of type 6, represented in FIG. 11, includes, on the one hand, a device for opening/closing the lateral walls of the set of molds which has arrived at the top of the cylinder served, this device preferably being made up with the aid of several main jacks 134 coupled to secondary jacks 135, and includes, on the other hand, a final mould release device D2 located at the left-hand end of the floor overhanging the cylinder, the device being mainly made up of a support framework 136 equipped with dual-acting jacks 137 connected to moving arms 138, this framework being equipped with suckers 139 and in some cases with vibrators, so that by placing on said framework a multi-purpose core na7, loaded with two posts, these are automatically taken up by the moving arms 138 which separate them and moves them away from the core thus performing the final phase of the deferred mould release.

The specific installation of type 7, represented in FIG. 4, includes a circular thermal screen 140 mounted in a fixed position right around the cylinder served with the aid of a few pieces 141 connecting it to an optimized structure, the screen being equipped with a series of electric or gas-fired radiant heaters 142 over approximately a quarter of its circumference, in the initial part of the latter with respect to the direction of rotation of the cylinder served.

The specific installation of type 8, represented in FIGS. 5 and 6, is a secondary cylinder termed utility cylinder located outside the main cylinder served, preferably in its longitudinal axial plane, firstly including a modular rotary framework 143 having the same rate of stepwise rotation as that of the main cylinder, the framework being equipped with several support seats 144 equipped in turn with a few rotary arms 145 ensuring the immobilization of the cured products P, fitted or not fitted with self-supporting top screens 39 while they tilt through 180°, secondly including vertical-transfer means 146 and horizontal-transfer means 147 for the cured products, and finally thirdly including an ergonomic workstation for the preparation of the reinforcements PA, so that this installation ensures, in succession:

cooling TT3 of the cured products while they are tilted through 180°;

vertical lowering and transfer of the cured products to the yard;

preparation of the reinforcements a as a group, advantageously with the aid of top screens 39, and in some cases of separation screens;

conveying of the reinforcements thus prepared right up to the top of the small cylinder while waiting for them to be taken up, either by an ordinary installation or, preferably, by a specific gripping installation.

The specific installation of type 9, represented in FIG. 1, includes two ergonomic walkways produced with the aid of a series of arms 148, preferably in the shape of a "Z", the arms having their bottom horizontal part made up in the form of a heat-insulated floor 149 and their top horizontal part equipped either with means 150 ensuring the tilting thereof or with means ensuring the sliding (vertical or horizontal) thereof, so that each time a molding means (mould or set of molds) stops at the top of the cylinder served, said walkways tilt or slide, one to the left and the other to the right of the molding means, thus facilitating access for the workforce, and so that once the molding means has been filled and closed, the two walkways retract, allowing the cylinder to rotate through one step, during which time said walkways act as guard rails.

The specific installation of type 10, represented in FIG. 14, includes a semicircular thermal screen made up of a strong framework 151, of a heat-insulated jacket 152, of two channel sections 153 and of a few sealing strips 154, so that by fitting this screen over the rings of a single-function cylinder by means of several rollers 155, it ensures, in addition to protection against inclement weather, automatic closure of the heating niches of the cylinder served and instantaneous melting of snow, while being very lightweight and of good quality.

The ability of the method easily to associate with any type of cylinder one or more installations of utilities, ordinary and/or specific, makes it possible to produce, with the aid of a few optimized assembly structures, numerous privileged associations, four of which are presented hereafter by way of example.

The first privileged association, represented in FIG. 1, incorporates a multi-function cylinder of type 1, two ordinary installations of utilities (one for feeding/distributing the concrete and one for cleaning/oiling the molds) and three specific installation of utilities of type 1, 2 and 9, with the aid of an optimized structure of type 1, including four entirely demountable main parts of which:

the first part is a multi-function framework having at least two portal frames 156 which are connected, on the one hand, by two strong beams 157 equipped with rails 158 so as to form a runway common both for the two aforementioned ordinary installations of utilities and for the specific installation of type 2, and which are connected, on the other hand, by two beams 159 supporting the cladding 160 and by two beams 161 supporting a lightweight roof structure 162, which roof structure encompasses the support beam 111 of the specific installation of type 1, and which are finally connected by two multi-purpose beams 163, preferably tubular ones, mounted in cantilever fashion with the aid of a few brackets with a high moment of inertia 164, the latter beams being equipped, on the one hand, with wall support pieces 165, platform support pieces 166, curtain support pieces 167 and sealing pieces 168 and, on the other hand, with ventilation means 169 and/or with heat recovery means 170;

the second part is made up of a few top platforms mounted directly on the aforementioned portal frames and with two lateral platforms 171, preferably heat-insulated, mounted in cantilever fashion on the multi-purpose beams 163, so that these latter platforms can support the specific installation of type 9 on their ends overhanging the cylinder;

the third part is made up, on the one hand, of two half ogive or arched-shaped lateral walls 172 mounted between the multi-purpose beams and the cladding support beams 159 and, on the other hand, of a few frontal walls 173 mounted, with or without doors and/or windows, on the ogive or arched-shaped walls 172;

the fourth part is made up of two lateral closure devices including a few curtains 174, with counterweights 175, mounted on winders 176 suspended with the aid of a few bearings 177 from the multi-purpose beams by means of said curtain support pieces 167 so as to facilitate the opening and closing of the two lateral spaces 178 used to store reels 179, molds, etc.

In order to facilitate mounting, the multi-function framework is preassembled on the ground and stood up vertically in one piece, except for the two multi-purpose beams which are mounted afterwards, already equipped with said lateral platforms 171 and with said devices with curtains 174 to 177.

The second privileged association, represented in FIGS. 4, 5 and 6, incorporates a multi-function cylinder of type 2, two ordinary installations of utilities (one for feeding concrete and one for cleaning/oiling the molds) and three specific installations of utilities of type 3, 7 and 8, with the aid of an optimized structure of type 2, including two main parts of which:

the first part is the main framework having two rows of posts 180 equipped with a series of small mounting brackets 181, the rows being connected firstly by two longitudinal beams 182 equipped with several gusset plates 183 having, welded to their ends, a few curved plates 184 which firstly ensure the mounting of the bottom part (approximately one third) of the thermal screen 140 forming the subject of the specific installation of type 7 and secondly the two lateral parts of said screen, the rows being connected secondly by two transverse box beams 185, so as to ensure the mounting of the cylinder by means of two preset bearing blocks 186, the rows being connected thirdly by two longitudinal beams 187 ensuring the mounting of five working and/or passage platforms, namely two top platforms 188, a central platform 189 located between the main cylinder and the secondary cylinder and two platforms 190 located laterally with respect to the secondary cylinder, the rows being connected fourthly by two longitudinal beams 191 equipped with gusset plates 192 having, on the one hand, plates (184), which ensure mounting of the two lateral parts of the specific installation of type 7 and having, on the other hand, a few arms 193 which facilitate the production of two lateral platforms 194 partly overhanging the cylinder, the rows being connected fifthly by two longitudinal beams 195 acting as support for the roof structure 196, the roof structure being made up of one or more assemblies preferably equipped, before mounting, with a runway 197 common to both the aforementioned ordinary installations and the specific installation of type 3;

the second part is the secondary framework having two top portal frames 198 connected by at least two longitudinal beams 199, the portal frames being equipped on the one hand with two support beams 200 fitted with vertical-adjustment means 201 so as to ensure the mounting of the specific installation of type 8 at the optimum height with respect to the main cylinder, and equipped on the other hand with two top walkways 202.

The third privileged association, represented in FIG. 10, incorporates, in the form of a floating workshop, a multi-function cylinder of type 6, all or some of the aforementioned ordinary installations of utilities and a specific installation of utilities of type 4 with the aid of an optimized structure of type 3 including two main parts, of which:

the first part is a ship's hull 203 reinforced by transverse 204 and longitudinal 205 ribs, the hull being equipped firstly with a multi-function bottom framework having transverse beams 206 and longitudinal beams 207 welded at the desired height onto the transverse ribs 204 so that said framework simultaneously provides support for the frames 208 for supporting and rotating the cylinder, support for the floor of the machine room (electric generator set, hydraulic unit, compressor, boiler, etc.) situated at one of the ends of the cylinder, support for the floor of the maintenance and various storage room situated at the other end of the cylinder, the raising up of said frames and floors in order to place them out of reach of any water which might infiltrate, the bracing of the hull, the uniform distribution of the loadings transmitted by the afore-mentioned equipment, and adjustable ballasting, the hull being equipped secondly with two floors 209 located at the two ends of the cylinder at an optimum height so as simultaneously to ensure the bracing of the lateral walls of the hull, the ground for the workstations outside the cylinder D2, E, NH2, PA, etc., the ground for the various auxiliaries (sanitary, laboratories, offices, etc.) and the ceilings of the aforementioned rooms (machine, maintenance, storage, etc.), the hull finally being equipped thirdly with two upper bridges 210, pivoting or not, overhanging the cylinder;

the second part is an attached arc-shaped framework 211, the bases of which bear on the lateral walls of the hull and the top part of which incorporates a runway common to both ordinary installations for feeding/distributing the concrete and for cleaning/oiling the molds, and common to a specific installation of type 4, which runway is advantageously made up of two beams 212 secured together and to the arc-shaped framework by gusset plates 213 so as to ensure, at the same time, the transverse stiffening and longitudinal bracing of said framework equipped with fixed or moving covering elements 214.

The fourth privileged association, represented in FIG. 11, incorporates a multi-function cylinder of type 7, all or some of the aforementioned ordinary installations of utilities, particularly those ensuring the feed/distribution of concrete and the cleaning/oiling of the molds, and two specific installations of type 5 and 6, with the aid of an optimized structure of type 4, comprising several rows of vertical posts 215 acting as support for:

a technical floor 216 with strong framework which can be singled out by means of its level overhanging the cylinder, by an opening of dimensions greater than those of the set of molds which is open at the top of the cylinder, by the support for a runway 217 mounted on the longitudinal edges of said opening in the floor and by its function as ceiling of the room 218 available for fitting out numerous ordinary installations of utilities;

a runway 219 with extension outside the structure allowing the specific installation of type 5 to serve both the workstations B, D1 and NH1 located axially with respect to the cylinder and the workstations E, D2, NH2, MP and MT located on the technical floor 216 transversely with respect to the cylinder;

several roof structure trusses, not represented;

a thermal screen 140, the upper two parts of which are secured to the technical floor 216 and to the posts 215 and the lower part of which rests on supports 220.

The method, cylinder-type factories and workshops according to the invention relate to the manufacture of moldable products, particularly those made of concrete with deferred mould release, giving a significant increase in productivity and quality.

While there have been shown and described what are considered preferred embodiments of the present invention, it will be apparent to those skilled in the art that various changes and modifications may be made therein without departing from the invention as defined by the appended claims.

What we claim is:

1. A method for manufacturing moldable products implementing optimized equipment and technological organization solutions comprising:

mounting a rotary body to a horizontal rotation axis for a rotation of more than 270°, wherein the rotary body is furnished on its periphery with a natural number of attachment means uniformly distributed around the periphery of the rotary body;

mounting molding means to each of the natural number of attachment means;

placing a first one of the molding means in a workstation position;

filling the first one of the molding means with material to be molded;

covering the first one of the molding means with a cover;

changing a position of the rotary body for a sequentially following one of the attachment means up to the natural number of the attachment means into the workstation position followed by the placing, the filling and the covering of additional molding means for each workstation position assumed;

curing the material to be molded in each one of the molding means during the rotation of the rotary body through more than 270° caused by the position changing of the rotary body for each sequentially following one of the attachment means up to the natural number of the attachment means;

then placing the first one of the molding means in the workstation position;

removing the cover from the first one of the molding means and removing a resulting molded structure from the first one of the molding means;

changing the position of the rotary body for the next one of the attachment means up to the natural number of the attachment means into the workstation position followed by the removing steps for each additional molding means for each workstation position assumed such that the molding means is rotated through more than 270° caused by the position changing of the rotary body for each sequentially following one of the attachment means up to the natural number of the attachment means;

then placing the first one of the molding means in the workstation position;

cleaning and oiling the first one of the molding means; and changing the position of the rotary body for the next one of the attachment means up to the natural number of the attachment means into the workstation position followed by the cleaning and oiling step for each additional molding means for each workstation position assumed such that the molding means is rotated through more than 270° caused by the position changing of the rotary body for each sequentially following one of the attachment means up to the natural number of the attachment means.

2. The method according to claim 1 further comprising:

placing reinforcements into each of the molding means before filling each of said molding means with the material to be molded; and tensioning the reinforcements.

3. A molding cylinder comprising:

a rotary body exhibiting an n-fold rotation axis running horizontally, wherein n is a natural number;

a bearing for engaging the rotary body and for supporting the rotary body to rotate around the n-fold rotation axis;

n attachment means attached to the rotary body and distributed uniformly around the rotary body such that the rotary body together with the n attachment means exhibits an n-fold symmetry axis;

n molding means, each attached to a corresponding one of the n attachment means;

n covers, wherein each of the n covers is attachable to a corresponding one of the molding means;

a workstation positioned at the rotary body such that the rotary body is rotatable by more than 270° and thereby each of the n attachment means is movable into a position to be sequentially engaged by the workstation; and driving means attached to the rotary body for moving the rotary body into n different positions such that in each position one of the n attachment means is engageable by the workstation and each of the n molding means is rotatable through more than 270° caused by the position changing of the rotary body for each sequentially following one of the n attachment means to allow for sequential repositioning of each of the n molding means at the workstation position for additional processing.

4. The molding cylinder according to claim 3, wherein the rotary body includes:

a lightweight metal framework composed of an outer polygonal membrane and an inner cylindrical membrane placed coaxially within the outer polygonal membrane, wherein the outer polygonal membrane is connected to the inner cylindrical membrane by top gusset plates attached at both ends of the inner cylindrical membrane and the outer polygonal membrane, and wherein intermediate gusset plates are placed between the top gusset plates and are situated perpendicular to a longitudinal axis of the rotary body, and wherein a space between the outer polygonal membrane and the inner cylindrical membrane is filled with concrete, two reinforcing rings attached at both ends of the rotary body, wherein each of the two reinforcing rings is closed at a free end by a closure element and has a raceway engaged with the driving means, wherein each of the n molding means is heated and includes shells, stiffening elements and sealing elements and is equipped with elastic bearing means, height-adjustment means, vibration means and steam-distribution means, and wherein the n covers are heat-insulated covers ensuring a closure of the n molding means during rotary travel of the rotary body.

5. The molding cylinder according to claim 3, wherein the rotary body includes a cylindrical membrane reinforced by longitudinal beams and bracing gusset plates, and closed at both ends by shields, wherein the shields are equipped in each case respectively with a rotation spindle and with a few slanting seats, wherein the n molding means are in a form of sets of molds and are equipped respectively with their elastic bearing means, height adjustment means, vibration means and lateral fixing means, and wherein the n covers are non heat-insulated covers held in a closed position during the rotary travel of the n molding means, so that material to be molded therein is heated by a passage of heat energy through said covers.

6. The molding cylinder according to claim 3, wherein the rotary body includes a cylindrical membrane reinforced by a plurality of box beams, wherein each box beam of the plurality of box beams is attached to an outer surface of the cylindrical membrane, wherein two neighboring box beams of the plurality of box beams form said one of the n attachment means, and a central support beam attached coaxially to the cylindrical membrane, wherein the bearing is formed by at least two raceways attached to an inner surface of the cylindrical membrane.

7. The molding cylinder according to claim 3, wherein the rotary body includes a cross-shaped rotary structure having a hollow square beam longitudinally reinforced by sections and transversely reinforced by gusset plates, wherein four arms of the cross-shaped rotary structure form said n attachment means, prebalanced bearing blocks attached to both sides of the hollow square beam to allow the rotary body to be supported by preestablished foundations after road or rail transport means of international gauge width have been removed.

8. The molding cylinder according to claim 3, wherein the rotary body includes a tubular central beam reinforced transversely by thin plate elements for stiffening and reinforced longitudinally by at least four multi-function peripheral beams, each one being equipped with two mold bedplate arms wherein the two mold bedplate arms of two neighboring multi-function peripheral beams form said one of the n attachment means, and prebalanced bearing blocks attached to both sides of the tubular central beam to allow the rotary body to be supported by preestablished foundations after road or rail transport means have been removed.

9. The molding cylinder according to claim 3, wherein the rotary body includes a cylindrical membrane reinforced longitudinally by box beams and closed by thin plate elements at both ends of the rotary body, wherein two neighboring box beams form said one of the n attachment means, wherein the n molding means are formed as sets of molds, wherein each set of molds includes a support shell having a support framework and two fixed lateral walls slightly inclined outwards, wherein the support shell is equipped with elastic bearing pads, vibrators and with pieces for closing an upper side of said molds, a multi-function removable core made up of a shell.

10. The molding cylinder according to claim 3, wherein the rotary body includes a cylindrical membrane reinforced by a plurality of longitudinal beams equipped with mold support seats and with immobilizing pieces with elastic contact and attached to an outer surface of the cylindrical membrane and reinforced transversally by rings attached to an inner surface of the cylindrical membrane, thin plate elements closing the cylindrical membrane at both ends of the cylindrical membrane, two raceways attached to the outer surface of the cylindrical membrane, wherein two neighboring longitudinal beams of the plurality of longitudinal beams form said one of the n attachment means, wherein the n molding means are made as sets of molds, said sets of molds being made up of a support shell of open type having a common bottom and two tilting and heating lateral walls, the support shell being equipped with reservation pieces, elastic supports, vibrators and pipes for distribution of steam, and said sets of molds being made up of at least one removable multi-function core.

11. The molding cylinder according to claim 3, wherein the rotary body includes a cylindrical membrane closed at both ends by two thin plate elements and reinforced longitudinally by a plurality of rail-beams stiffened by support gusset plates and attached to an outer surface of the cylindrical membrane, wherein two neighboring rail-beams of the plurality of rail-beams (82) form said one of n attachment means, and a rotary device disposed in the cylindrical membrane of the rotary body for distributing steam.

12. The molding cylinder according to claim 3, wherein the rotary body includes a tubular beam reinforced longitudinally by a plurality of longitudinal beams attached radially in a form of V-shaped pairs at first edges of individual longitudinal beams of the plurality of longitudinal beams to an outer surface of the tubular beam, two peripheral rings attached to second edges of said longitudinal beams of the plurality of longitudinal beams at ends of said longitudinal beams of the plurality of longitudinal beams, wherein two neighboring longitudinal beams of different V-shaped pairs of longitudinal beams of the plurality of longitudinal beams form said one of the n attachment means.

13. The molding cylinder according to claim 3, wherein the rotary body includes a hollow cylinder, and a plurality of box rings attached to an outer surface of the hollow cylinder, wherein two neighboring box rings of the plurality of box rings form said one of n attachment means.

14. The molding cylinder, according to claim 3, wherein the workstation includes a first handling installation having a horizontal beam, two synchronized electric pulley blocks and grippable means, associated with the rotary body to be served, in order to handle each of the n covers for closing each of the n molding means;

a second handling installation having synchronized gripping devices suspended from a lifting and longitudinal transfer apparatus via a beam balanced by cables, associated with the rotary body to be served, in order to handle each of the n molding means, to handle reinforcements, to release each of the n molding means and to transfer cured products;

a third handling installation including a tilting beam having tilting means, means for gripping each of the n covers and means for gripping the cured products and reinforcements, said tilting beam being suspended from a moving carriage for horizontal transfer, said installation being associated with the rotary body to be served in order to provide handling of each of the n molding means, to remove and to put down each of the n covers, to handle the reinforcements, and to release each of the n molding means and to transfer the cured products;

a fourth handling installation including a multi-purpose carriage incorporating horizontal-displacement means, vertical-displacement means and gripping means, said installation being associated with the rotary body to be served in order to provide handling of each of the n molding means, to remove and to transfer multi-function cores, having cured products, as well as to put down said cores equipped with reinforcements into the support-shell having been cleaned and oiled; and a fifth handling installation including a device equipped with a central row of means for gripping the cores and two lateral rows of means for gripping the cured products.

15. The molding cylinder, according to claim 3, wherein the workstation includes a specific installation for a heat treatment having a thermal screen with rotational symmetry and mounted in a fixed position around the rotary body to be served by means of connection elements, the thermal screen being equipped with a series of radiant heaters over approximately a third of a circumference of the thermal screen in the initial part of said third of the circumference of the thermal screen, in order that a constant stepwise rotation of the n molding means in front of said screen automatically provides an intensive heat treatment of material to be molded.

16. The molding cylinder, according to claim 3, wherein the workstation includes a specific installation for cooling and evacuating cured products as well as preparing reinforcements including:

a modular rotary framework having a same rate of stepwise rotation as that of the rotary body to be served, the framework being equipped with several support seats for the cured products and equipped in turn with a plurality of rotary arms ensuring immobilization of the cured products in said seats during their rotation of 180° which provides the cooling of said cured products;

a compact device for evacuation, incorporating vertical and horizontal transfer means for the cured and cooled products; and a station for locating the reinforcements.

17. The molding cylinder, according to claim 3, further comprising:

two ergonomic walkways made of a series of arms having a shape of a "Z", wherein a bottom horizontal part of the two ergonomic walkways incorporates a heat-insulated floor and wherein a top horizontal part of the two ergonomic walkways is equipped with means ensuring a tilting of the two ergonomic walkways.

18. The molding cylinder, according to claim 3, further comprising:

a multi-function framework having at least two portal frames which are connected, the portal frames being equipped with rails forming a runway;

two lateral platforms mounted in cantilever fashion on multi-purpose beams;

two lateral walls having s shape of a half ogive or arched, mounted overhanging the rotary body between two multi-purpose beams and cladding support beams, and two frontal walls mounted between the portal frames and the half-ogive or arched shaped walls; and two devices made of curtains, with counterweights, mounted on winders suspended via bearings and connection pieces from the multi-purpose beams.

19. The molding cylinder, according to claim 3, further comprising:

a secondary cylinder located outside of the rotary body in a longitudinal axial plane of the rotary body and having a modular rotary framework having a same rate of stepwise rotation as the rotary body and having a plurality of sets of support seats equipped with rotary arms for immobilization of resulting molded structure;

wherein the workstation includes a main framework having two rows of posts disposed at both sides of the rotary body and situated parallel to a longitudinal axis of the rotary body, wherein said posts are connected firstly by two longitudinal beams running along said rows and equipped with several gusset plates having a few curved plates for ensuring mounting of a bottom part (approximately one third) of a thermal screen and of two lateral parts of said thermal screen, and wherein said posts are connected secondly by two transverse box beams for mounting the rotary body by means of two preset bearing blocks, and wherein said posts are connected thirdly by two longitudinal beams for mounting a plurality of platforms wherein said posts are connected fourthly by two longitudinal beams equipped with gusset plates having plates for mounting the two lateral parts of the thermal screen and having a few arms which facilitate production of two platforms of the plurality of platforms partly overhanging the rotary body, wherein said posts are connected fifthly by two longitudinal beams acting as support for a roof structure, the roof structure being made up of one or more assemblies equipped with a runway; and a secondary framework having two top portal frames connected by at least two longitudinal beams, wherein each of the two portal frames is disposed at a side of the rotary body and between the rotary body and one of said two rows of posts and is equipped with two support beams fitted with vertical-adjustment means for mounting a rotating device at an optimum height with respect to the rotary body and equipped with two top walkways.

20. The molding cylinder, according to claim 3, further comprising:

a ship's hull reinforced by transverse and longitudinal ribs, the ship's hull being equipped firstly with a multi-function bottom framework having transverse beams and longitudinal beams welded at the desired height onto the transverse ribs so that said framework simultaneously provides support for frames for supporting and rotating the rotary body, support for a floor of a machine room capable of housing an electric generator set, a hydraulic unit, a compressor, and a boiler and situated at a first end of the rotary body, support for the floor of maintenance and various storage rooms situated at a second end of the rotary body, the ship's hull being equipped secondly with two floors located at the ends of the rotary body at an optimum height so as simultaneously to ensure bracing lateral walls of the ship's hull, the ship's hull being equipped thirdly with two upper bridges overhanging the rotary body; and an arc-shaped framework, wherein bases of the arc-shaped framework bear on the lateral walls of the ship's hull and wherein a top part of the arc-shaped framework incorporates a runway common for installations for feeding and distributing material to be molded and for cleaning and oiling molding means, wherein the runway is made up of two beams secured together and wherein the two beams are attached to the arc-shaped framework by gusset plates.

21. The molding cylinder, according to claim 3, further comprising:

a technical floor with strong framework mounted on several rows of posts, wherein the technical floor overhangs the rotary body and has an opening of dimensions greater than dimensions of the molding means and situated at a top of the rotary body, wherein the technical floor has a support for a runway mounted on longitudinal edges of said opening of the technical floor, wherein the runway has an extension to serve workstations located axially with respect to the rotary body and workstations located on the technical floor transversely with respect to the rotary body; and a thermal screen secured to the technical floor, to said posts and to supports made of concrete.

22. The molding cylinder according to claim 19, wherein the plurality of platforms are working platforms and include two top platforms, a central platform located between the rotary body and the secondary cylinder, and the two platforms partly overhanging the rotary body, wherein the two platforms partly overhanging the rotary body are located laterally with respect to the secondary cylinder.

23. The molding cylinder according to claim 19, wherein the plurality of platforms are passage platforms and include two top platforms, a central platform located between the rotary body and the secondary cylinder, and the two platforms partly overhanging the rotary body, wherein the two platforms partly overhanging the rotary body are located laterally with respect to the secondary cylinder.

24. A method for manufacturing moldable products implementing equipment and technological organization solutions, aiming to improve a concentration, automation and flexibility of a manufacturing process as well as a curing of molded material, comprising:

forming a plurality of molding means into a rotary structure shaped as a modular rotary cylinder having at least two faces, rotatable by more than 270°;

setting a main workstation around the modular rotary cylinder;

setting installation of utilities specific to the main workstation grouped together around the modular rotary cylinder;

setting the modular rotary cylinder into a position in which a first molding means of the plurality of molding means is in a defined upper position;

filling the first molding means with material to be molded;

closing the first molding means filled with the material to be molded with a first cover of a plurality of covers;

repeating operations of setting, filling and closing until all molding means of the plurality of molding means are set, filled and closed;

adjusting elastic suspensions of said molding means for moldable transmission of vibrations, produced during compacting of the material to be molded, to all of the molding means filled with material to be molded;

treating the material being completely enclosed in said molding means intensively with heat over a travel distance substantially equal to a rotation of the modular rotary cylinder up to 360° and resulting in an enhanced neutralization of an expansion of gases occluded within the material to be molded and of leakage by evaporation of molecules of water which are indispensable for quality hydration;

performing a total multi-axis hydration of molecules in the material to be molded due jointly to a change in inclination of the material to be molded during the 360° rotation of the modular rotary cylinder and to the vibrations;

resetting the modular rotary cylinder into the position in which the first molding means of the plurality of molding means is in the defined upper position;

releasing the first molding means of the plurality of molding means;

removing the first cover of the plurality of covers;

evacuating cured products from the first molding means of the plurality of molding means;

transporting the cured products outside of the modular rotary cylinder;

cleaning and oiling the first molding means of the plurality of molding means; and repeating operations of releasing the molding means, removing the covers, evacuating and transporting the cured products, cleaning and oiling the molding means until all molding means of the plurality of molding means are cleaned and oiled by repetitively resetting the modular rotary cylinder such that each of the plurality of molding means is positioned in the defined upper position during the operations of releasing, evacuating, transporting, cleaning, and oiling.

25. A method according to claim 24, wherein for manufacturing products made of prestressed concrete and reinforced concrete, prior to filling the first molding means of the plurality of molding means, the following steps occur:

placing reinforcements into the first molding means; and tensioning the reinforcements.

26. The method for manufacturing moldable products according to claim 25, further comprising placing cores in said molding means prior to filling.

27. The method for manufacturing moldable products according to claim 25, further comprising automatically replacing the first molding means of the plurality of molding means, loaded with the cured products, by resetting the modular rotary cylinder into the position in which the first molding means of the plurality of molding means is in the defined upper position, and wherein the steps of placing and tensioning the reinforcements are carried out simultaneously with a release of the molding means, an evacuation of the cured products, and a cleaning and oiling of the molding means.

28. The method for manufacturing moldable products according to claim 25, further comprising forming a secondary cylinder on a side of the modular rotary cylinder; and transferring one molding means of the plurality of molding means onto the secondary cylinder.

29. A method for producing molded pieces comprising:

mounting a rotor to a rotation axis, wherein the rotor is furnished on its periphery with a natural number of attachment means uniformly distributed around the periphery of the rotor;

mounting a molding form to each of the natural number of attachment means;

placing a first one of the molding means in a workstation position;

filling the first one of the molding means with material to be molded;

covering the first one of the molding means with a cover;

changing the position of the rotor for a sequentially following one of the attachment means up to the natural number of the attachment means into the workstation position followed by the placing, the filling and the covering of additional molding means for each workstation position assumed;

curing the molded material in each one of the molding means during the rotation of the rotary body through more than 270° caused by the position changing of the rotary body for each sequentially following one of the attachment means up to the natural number of the attachment means;

placing the first one of the molding means in the workstation position;

removing the cover from the first one of the molding means and a resulting molded structure from the first one of the molding means;

changing the position of the rotary body for a sequentially following one of the attachment means up to the natural number of the attachment means into the workstation position followed by the removing steps for each additional molding means for each workstation position assumed such that the molding means is rotated through more than 270° caused by the position changing of the rotary body for each sequentially following one of the attachment means up to the natural number of the attachment means;

placing the first one of the molding means in the workstation position;

cleaning and oiling the first one of the molding means; and changing the position of the rotary body for a sequentially following one of the attachment means up to the natural number of the attachment means into the workstation position followed by the cleaning and oiling step for each additional molding means for each workstation position assumed such that the molding means is rotated through more than 270° caused by the position changing of the rotary body for each sequentially following one of the attachment means up to the natural number of the attachment means.

* * * * *

UNITED STATES PATENT AND TRADEMARK OFFICE

CERTIFICATE OF CORRECTION

PATENT NO. : 5,728,327

DATED : March 17, 1998

INVENTOR(S) : BORCOMAN et al.

It is certified that error appears in the above-indentified patent and that said Letters Patent is hereby corrected as shown below:

On the title page, item [63], should read as follows:

[63] Continuation-in-part of PCT/FR93/00004 Jan. 5, 1993.

Signed and Sealed this

Third Day of November, 1998

*Attest:*

*Attesting Officer*

BRUCE LEHMAN

*Commissioner of Patents and Trademarks*